US011918127B2

(12) United States Patent
Yang

(10) Patent No.: US 11,918,127 B2
(45) Date of Patent: Mar. 5, 2024

(54) SAFE BASSINET

(71) Applicant: XIAMEN BABY PRETTY PRODUCTS CO., LTD., Xiamen (CN)

(72) Inventor: Jianbo Yang, Xiamen (CN)

(73) Assignee: XIAMEN BABY PRETTY PRODUCTS CO., LTD., Xiamen (CN)

( * ) Notice: Subject to any disclaimer, the term of this patent is extended or adjusted under 35 U.S.C. 154(b) by 178 days.

(21) Appl. No.: 17/515,524

(22) Filed: Oct. 31, 2021

(65) Prior Publication Data

US 2022/0330714 A1 Oct. 20, 2022

(30) Foreign Application Priority Data

Apr. 18, 2021 (CN) ..... 202120788403.2

(51) Int. Cl.
*A47D 9/02* (2006.01)
*A47D 9/00* (2006.01)
*A47D 15/00* (2006.01)

(52) U.S. Cl.
CPC ..... *A47D 9/02* (2013.01); *A47D 9/012* (2022.08); *A47D 15/008* (2013.01)

(58) Field of Classification Search
CPC ..... B62B 7/00; A47D 15/008; A47D 13/105; A47D 9/00; A47D 9/02; A47D 9/057; A47D 9/005; A47D 9/008
USPC ..... 5/106
See application file for complete search history.

(56) References Cited

U.S. PATENT DOCUMENTS

2014/0014791 A1* 1/2014 Shan ..... A47D 9/005 248/188.7
2017/0065097 A1* 3/2017 Chen ..... A47D 9/02
2018/0206651 A1* 7/2018 Gallina ..... A47D 7/04

FOREIGN PATENT DOCUMENTS

CN 208030773 U * 11/2018 ..... A47D 7/01
CN 110269434 A * 9/2019
WO WO-2020245713 A1 * 12/2020 ..... A47D 7/02

* cited by examiner

*Primary Examiner* — Justin C Mikowski
*Assistant Examiner* — Adam C Ortiz
(74) *Attorney, Agent, or Firm* — Bayramoglu Law Offices LLC

(57) ABSTRACT

The safe bassinet includes a left support frame, a right support frame and a sleeping basket frame, where the top of the left support frame and the top of the right support frame are respectively provided with a left bending rod and a right bending rod; the sleeping basket frame is provided between the left bending rod and the right bending rod; the sleeping basket frame is covered with a cloth cover; a left end and a right end of the sleeping basket frame are respectively provided with a left slider and a right slider; a right end of the left bending rod and a left end of the right bending rod are respectively provided with a left fixed block and a right fixed block; the left slider and the right slider are respectively slidable up and down relative to the left fixed block and the right fixed block.

12 Claims, 20 Drawing Sheets

SAFE BASSINET

CROSS REFERENCE TO THE RELATED APPLICATIONS

This application is based upon and claims priority to Chinese Patent Application No. 202120788403.2 filed on Apr. 18, 2021, the entire contents of which are incorporated herein by reference.

TECHNICAL FIELD

The present invention relates to the field of children's products, in particular to a safe bassinet.

BACKGROUND

In the prior art, a multipurpose bassinet includes a left support frame, a right support frame, a swing frame and a sleeping basket frame. The swing frame and the sleeping basket frame are provided between the left support frame and the right support frame. The swing frame is swingably connected to the left support frame and the right support frame. The sleeping basket frame is detachably connected to the swing frame. The left support frame and the right support frame have the same structure and are arranged oppositely. The left support frame and the right support frame are respectively provided with a rotating device on the top to control the swing of the swing frame. The rotating device can rotate by 90°. When the swing frame is fixed, the sleeping basket frame is fixed with the swing frame, which is used as a crib. When the swing frame swings, the sleeping basket frame swings with the swing frame, which is used as a cradle. The rotating device has only a single-lock function, which is prone to misoperation, especially by the baby.

SUMMARY

In order to solve the above-mentioned problems existing in the prior art, an objective of the present invention is to provide a safe bassinet.

The present invention is implemented by the following technical solution:

A safe bassinet includes a left support frame, a right support frame and a sleeping basket frame, where the top of the left support frame and the top of the right support frame are respectively provided with a left bending rod and a right bending rod; the sleeping basket frame is provided between the left bending rod and the right bending rod; the sleeping basket frame is covered with a cloth cover; a left end and a right end of the sleeping basket frame are respectively provided with a left slider and a right slider; a right end of the left bending rod and a left end of the right bending rod are respectively provided with a left fixed block and a right fixed block; the left slider and the right slider are respectively slidable up and down relative to the left fixed block and the right fixed block; the left bending rod and the right bending rod are respectively rotatably connected to the left fixed block and the right fixed block; top surfaces of the left fixed block and the right fixed block both are provided with a separation button and a swing button; the separation buttons drive the left fixed block and the right fixed block to be separated from the corresponding left slider and right slider, respectively; the swing buttons drive the left fixed block and the right fixed block to descend to be separated from the corresponding left slider and right slider, respectively; and the swing buttons drive the left fixed block and the right fixed block to swing with the corresponding left bending rod and right bending rod, respectively.

The left fixed block and the right fixed block respectively may include an inner fixed block and an outer fixed block that may be connected to each other; an outer side surface of the left slider and an outer side surface of the right slider may be respectively provided with an opening; an entrance of the opening may be provided with a front guide bar and a rear guide bar; an inner side surface of the outer fixed block may be provided with a front guide groove and a rear guide groove that may be respectively adapted to the front guide bar and the rear guide bar; the inner fixed block may be located in the opening, and may be located inside the front guide bar and the rear guide bar; and the left bending rod and the right bending rod respectively may include an inner bending shell and an outer bending shell that may be connected to each other.

The separation button may be located in the top of the inner fixed block; a plug may be provided in the top of the inner fixed block; an inner end of the plug may extend out of an inner side surface of the inner fixed block; a first spring may be provided between an outer end of the plug and the outer fixed block; an upper part of an inner end surface of the opening may be provided with a socket for inserting the plug; the top of the plug may be provided with a first driving part; a top surface of the first driving part may be a first inclined surface that may be inclined inward and downward; the bottom of the separation button may be provided with a first pressing part; and an outer side surface of the first pressing part may be provided with a second inclined surface that fits the top surface of the first driving part.

The inner side surface of the inner fixed block may be provided with a mounting groove; the mounting groove may be provided therein with a splayed clamping block; one end of the splayed clamping block passes through the inner fixed block and may be connected to a connecting part; a top surface of the connecting part may be provided with second driving parts; the connecting part and the second driving parts may be arranged in the outer fixed block and may be movable in left and right directions; top surfaces of the second driving parts may be third inclined surfaces that may be inclined inward and downward; the swing button may be provided in an upper part of the outer fixed block; the swing button may include a first button body and a first sliding cover; a top surface of the first button body may be provided with a first sliding groove; the first sliding cover may be located in the first sliding groove; the bottom of the first sliding cover may be provided with a first connecting rod; the first button body may be provided with a first sliding space; the first sliding space may be provided therein with a first sliding part; a second spring may be provided between a side surface of the first sliding part and a side surface of the first sliding space; the bottom of the first connecting rod passes through the first button body and may be connected to the first sliding part; the outer fixed block may be provided therein with a second pressing part; an outer side surface of the second pressing part may be provided with a fourth inclined surface that fits the top surfaces of the second driving parts; the first sliding part may be located above the second pressing part; a bottom surface of the first button body abuts against a top surface of the second pressing part; left and right side surfaces of the second pressing part both may be provided with two grooves that may be spaced apart; left and right ends of a bottom surface of the first sliding part both may be provided with two protruding parts that may be spaced apart; the two protruding parts correspond to two grooves on the same side; the outer fixed block may be provided therein with two left clamping points that may be spaced apart and two right clamping points that may be spaced apart; the two left clamping points may be located in corresponding two grooves; the two right clamping points may be located in corresponding two grooves; bottom surfaces of the protruding parts may be fifth inclined surfaces that may be inclined rearward and downward; top surfaces of the left clamping points and the right clamping points may be sixth inclined surfaces that fit the fifth inclined surfaces; the inner end surface of the opening may be provided with a splayed clamping edge that may be adapted to and abut against the splayed clamping block; the connecting part may be provided with a guide rod; the outer fixed block may be provided with a central shaft; the central shaft may be provided with a rod hole for the guide rod to pass through; and a third spring may be provided between the connecting part and the outer fixed block.

The splayed clamping block may be shaped like a left square bracket "[" in a top view; the splayed clamping block may be provided therein with a vertical plate and a pusher; a top outer side surface of the vertical plate may be a seventh inclined surface that may be inclined inward and downward; a rear top surface of the pusher may be an eighth inclined surface that fits the seventh inclined surface; the pusher may be shaped like "[" in a left view; the pusher may be located at an outer end of the vertical plate; there may be two second driving parts; the two second driving parts may be spaced apart in front and rear directions; a top transverse part of the pusher passes between the two second driving parts, and a bottom transverse part of the pusher may be located below the connecting part; the top transverse part and the bottom transverse part of the pusher pass through the outer fixed block; an inner end surface of the inner fixed block may be provided with a rod groove; the rod groove may be provided therein with a strip groove; a clamping rod may be provided in the rod groove; an inner end surface of the clamping rod may be provided with an abutting protrusion; an outer end surface of the clamping rod may be provided with a connecting bar; the connecting bar passes through the strip groove and may be connected to the bottom of the vertical plate; the vertical plate and the pusher may be located in the inner fixed block; a fourth spring may be provided between the bottom of the vertical plate and an inner bottom surface of the inner fixed block; a movable member may be provided between the inner bending shell and the outer bending shell; an outer periphery of the movable member may be evenly provided with multiple clamping parts; an outer end of the outer fixed block may be provided with multiple clamping grooves; each clamping groove corresponds to one clamping part; the multiple clamping parts pass through the inner bending shell and may be clamped in the corresponding clamping grooves; an inner end surface of the movable member may be provided with two abutting rods; the top transverse part and the bottom transverse part of the pusher respectively correspond to the abutting rods; the two abutting rods pass through the inner bending shell and may be located in the outer fixed block; a fifth spring may be provided between the movable member and the outer bending shell; an outer end of the outer fixed block may be evenly provided with multiple limit rods; the inner bending shell may be evenly provided with multiple arc through holes; each limit rod corresponds to one arc through hole, and each limit rod passes through the corresponding arc through hole; and the guide rod passes through the inner bending shell.

An outer end of the inner bending shell may be provided with two symmetrical sleeve posts, two symmetrical centering springs and two symmetrical connecting members; each centering spring corresponds to one sleeve post and one connecting member; one end of the centering spring may be sleeved on the sleeve post, and the other end of the centering spring may be clamped on the connecting member; the two connecting members respectively correspond to one arc through hole; and inner ends of the connecting members may be connected to the corresponding limit rods.

The left support frame and the right support frame respectively may include a support sleeve, a support base, a support rod and a sleeve rod; the bottom of the support base may be connected to the support sleeve; the bottom of the support rod may be connected to the top of the support base; the sleeve rod may be sleeved on the support rod, and the sleeve rod may be able to ascend and descend relative to the support rod; the bottom of the sleeve rod may be provided with a clamping device for adjusting the height of the sleeve rod; the left bending rod and the right bending rod may be respectively provided with a lift button for pulling the clamping device up and down; a pull rope may be provided between the lift button and the clamping device; and the bottom of the lift button may extend out of the bottom of the corresponding left bending rod or right bending rod.

The lift button may include a second button body and a second sliding cover; a bottom surface of the second button body may be provided with a second sliding groove; the second sliding cover may be located in the second sliding groove; the top of the second sliding cover may be provided with a second connecting rod; the second button body may be provided therein with a second sliding space; the second sliding space may be provided with therein a second sliding part; a sixth spring may be provided between one end of the second sliding part and one end of the second sliding space; the top of the second connecting rod passes through the second button body and may be connected to the second sliding part; the second button body may be hinged to the inner bending shell and the outer bending shell; the other end of the second button body may be provided with a pull rod; a seventh spring may be provided between the pull rod and an upper part of the inner bending shell; a winding wheel may be provided in the inner bending shell; one end of the pull rope may be connected to the bottom of the pull rod, and the other end of the pull rope may be wound around the winding wheel and may be connected to the clamping device; a top surface of the second button body may be provided with two symmetrical limit cuts; inner and outer ends of the second sliding part may be respectively provided with extending parts that abut against the corresponding limit cuts; the inner bending shell may be provided therein with an abutting part extending outward; and when the second sliding part may be in a non-sliding state, a top surface of the second sliding part may abut against the abutting part.

The clamping device may include a casing, a lifting block and a clamping block; the casing may be fixedly provided at the bottom of the sleeve rod; the lifting block and the clamping block may be arranged in the casing; the lifting block may be used to drive the clamping block to move in left and right directions; an outer side surface of the clamping block may be provided with a clamping plate; an inner side surface of the support rod may be provided with multiple clamping openings that may be spaced apart up and down for one end of the clamping plate to be clamped into; the bottom of the pull rope may be connected to the lifting block; an eighth spring may be provided between a top surface of the lifting block and an inner top surface of the casing; the lifting block may include a head part and a third driving part; a junction of the head part and the third driving part may be a bending part; a front side surface of the bending part may be a ninth inclined surface; a top surface of the clamping block may be a tenth inclined surface that fits the ninth inclined surface; a protrusion may be provided on a top inner side surface of the clamping block; a bottom surface of the protrusion may be an eleventh inclined surface; an outer side surface of the protrusion may abut against an inner side surface of the third driving part; the inner side surface of the third driving part may be provided with a twelfth inclined surface that fits the eleventh inclined surface; a ninth spring may be provided between an inner side surface of the clamping block and an inner side surface of the casing; a lower rear side surface of the clamping block may be provided with a limit plate; and the limit plate may be located below the third driving part.

The sleeping basket frame may include a left guide rail, a right guide rail, a lifting tube, a bottom rod, an upper bending tube and a lower bending tube; the upper bending tube may be provided between a top front end of the left guide rail and a top front end of the right guide rail; the lower bending tube may be provided between a bottom front end of the left guide rail and a bottom front end of the right guide rail; the bottom rod may be provided between a bottom inner side of the left guide rail and a bottom inner side of the right guide rail; an inner side surface of the left guide rail and an inner side surface of the right guide rail may be respectively provided with a lifting member; the lifting tube may be provided between the lifting member of the left guide rail and the lifting member of the right guide rail; the lower bending tube may be provided with two symmetrical lower tube sleeves; the upper bending tube may be provided with two symmetrical upper tube sleeves; each lower tube sleeve corresponds to one upper tube sleeve; a reinforcing rod may be provided between the corresponding upper tube sleeve and lower tube sleeve; the bottoms of the two lower tube sleeves may be respectively provided with a sleeve with an open structure inside; the sleeve may be sleeved on the lower bending tube; and the left slider and the right slider may be connected to the upper bending tube.

The cloth cover may include a front cloth cover and a rear cloth cover; the front cloth cover may be connected to the upper bending tube and the lower bending tube; an upper part of the rear cloth cover may be sleeved on the lifting tube; a left end and a right end of the rear cloth cover may be respectively provided with a left zipper belt and a right zipper belt; the left zipper belt and the right zipper belt may be respectively provided with zipper teeth; the left guide rail and right guide rail may be respectively provided with a hollow structure; the left guide rail and the right guide rail both may include a front guide shell and a rear guide shell that may be connected to each other; a front partition may be provided in the front guide shell, and a rear partition may be provided in the rear guide shell; a first through hole from top to bottom may be formed on an inner side surface after the front guide shell and the rear guide shell that may be connected; a second through hole from top to bottom may be formed between the front partition and the rear partition after the front guide shell and the rear guide shell may be connected; the left zipper belt and the right zipper belt pass through the corresponding first through hole and second through hole; the zipper teeth of the left zipper belt and the zipper teeth of the right zipper belt may be respectively located in the left guide rail and the right guide rail; the zipper teeth of the left zipper belt block an outer side of the front partition and the rear partition in the left guide rail; the zipper teeth of the right zipper belt block an outer side of the front partition and the rear partition in the right guide rail; the bottom of the rear cloth cover may be wound around the bottom of the bottom rod; the bottom of the rear cloth cover may be provided with multiple elastic belts; a front end of the lower bending tube may be provided with multiple winding members; each winding member corresponds to one elastic belt; each winding member may be provided with a winding hole; one end of each elastic belt may be connected to one side surface of the bottom of the rear cloth cover; and the other end of each elastic belt passes through the corresponding winding hole and may be connected to the other side surface of the bottom of the rear cloth cover.

A telescopic inner tube may be provided in a rear end of the support sleeve; a compression spring may be provided in the support sleeve along a length direction; a front end of the inner tube may be provided therein with a V-shaped elastic piece; a top surface of the V-shaped elastic piece may be provided with a clamping bead; a rear top surface of the inner tube may be provided with a clamping hole for the clamping bead to extend outward; the clamping bead may be located on a rear side of the support sleeve; the rear end of the support sleeve may be provided with a connecting post that may be L-shaped in a top view; an end of the connecting post may be provided with a frustum part; a transverse part of the connecting part may be provided with a slit; the slit respectively divides the transverse part and the frustum part of the connecting post into two halves; the rear end of the support sleeve may be provided with a lug; and the lug may be provided with a circular hole for inserting the two halves of the frustum part.

The above description of the present invention shows that compared with the prior art, the present invention has the following advantages. The present invention has a novel structure and clever design. When the sleeping basket frame needs to swing, the separation button and the swing button on the top surface of the left fixed block are pressed simultaneously, and the separation button and the swing button on the top surface of the right fixed block are pressed simultaneously. The left fixed block and the right fixed block are separated from the corresponding left slider and right slider, and the left slider and the right slider descend to enter a swing state. Thus, the sleeping basket frame swings relative to the left bending rod and the right bending rod, thereby turning the sleeping basket frame into a cradle. To turn the bassinet of the present invention into a cradle, it is necessary to release a double-lock function, that is, to press the separation buttons and the swing buttons on the left fixed block and the right fixed block simultaneously. This improves the use safety of the bassinet, and avoids the potential safety hazard caused by the misoperation of the existing single-lock bassinet.

DETAILED DESCRIPTION OF THE EMBODIMENTS

Figure 1:
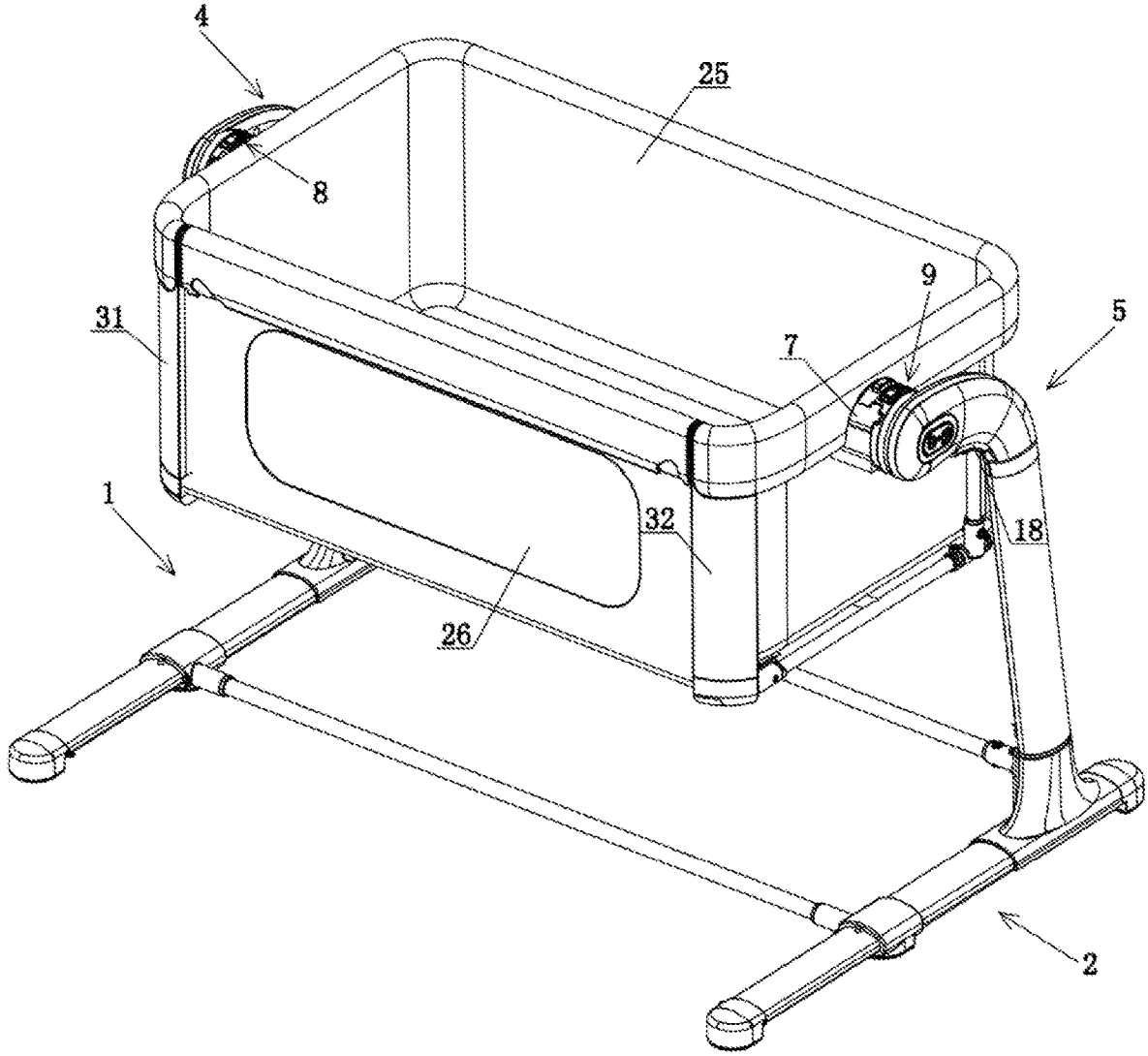
FIG. 1 is a view illustrating a structure according to the present invention.
Figure 2:
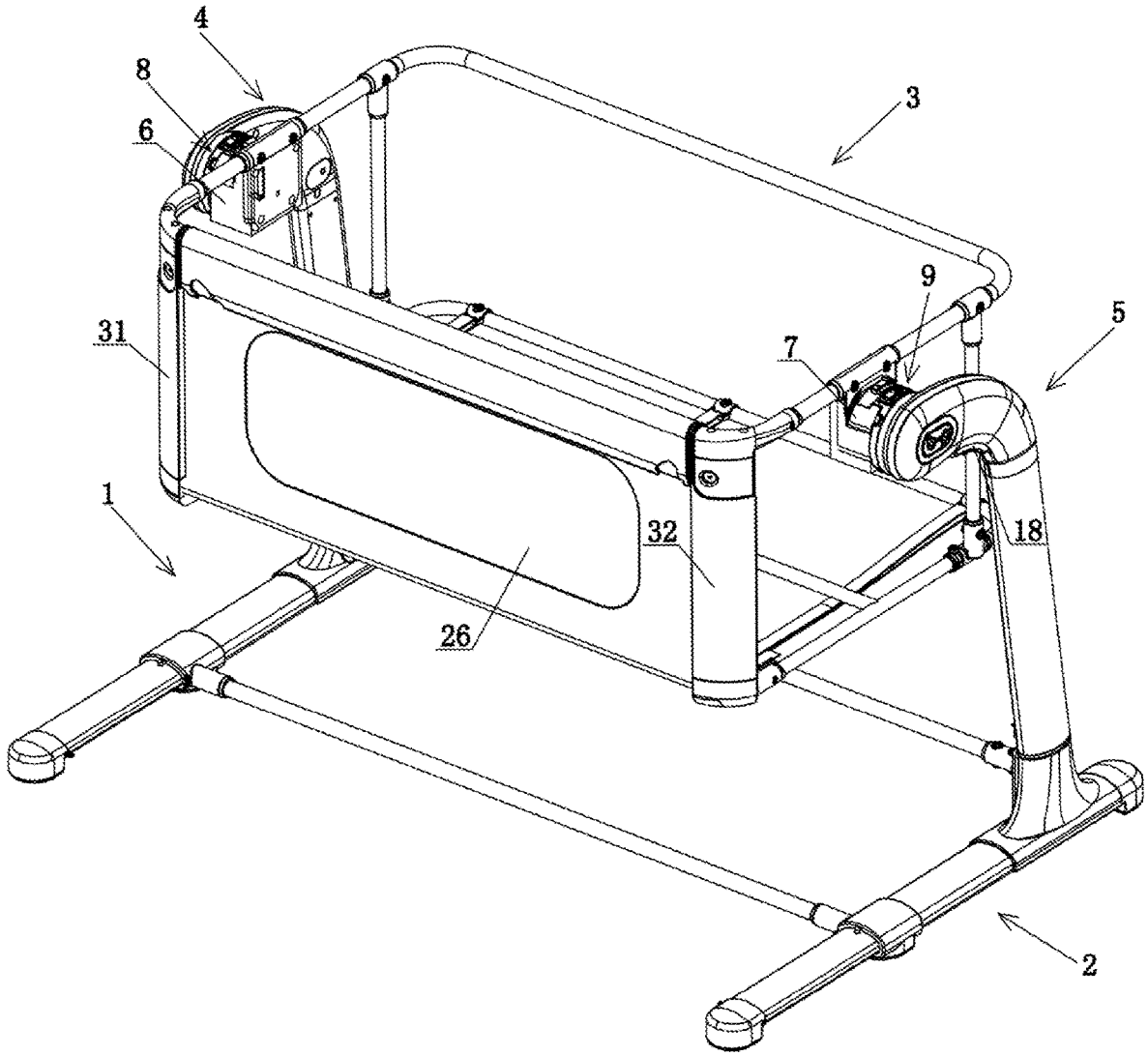
FIG. 2 is a view illustrating a structure after a front cloth cover shown in FIG. 1 is removed.

Referring to FIGS. 1 to 4, a safe bassinet includes a left support frame 1, a right support frame 2 and a sleeping basket frame 3. The top of the left support frame 1 and the top of the right support frame 2 are respectively provided with a left bending rod 4 and a right bending rod 5. The sleeping basket frame 3 is provided between the left bending rod 4 and the right bending rod 5. The sleeping basket frame is covered with a cloth cover. A left end and a right end of the sleeping basket frame 3 are respectively provided with a left slider 6 and a right slider 7. A right end of the left bending rod 4 and a left end of the right bending rod 5 are respectively provided with a left fixed block 8 and a right fixed block 9. The left slider 6 and the right slider 7 are respectively slidable up and down relative to the left fixed block 8 and the right fixed block 9. The left bending rod 4 and the right bending rod 5 are respectively rotatably connected to the left fixed block 8 and the right fixed block 9. Top surfaces of the left fixed block 8 and the right fixed block 9 both are provided with a separation button 10 and a swing button 11. The separation buttons 10 drive the left fixed block 8 and the right fixed block 9 to be separated from the corresponding left slider 6 and right slider 7, respectively. The swing buttons 11 drive the left fixed block 8 and the right fixed block 9 to descend to be separated from the corresponding left slider 6 and right slider 7, respectively. The swing buttons 11 drive the left fixed block 8 and the right fixed block 9 to swing with the corresponding left bending rod 4 and right bending rod 5, respectively.

Figure 3:
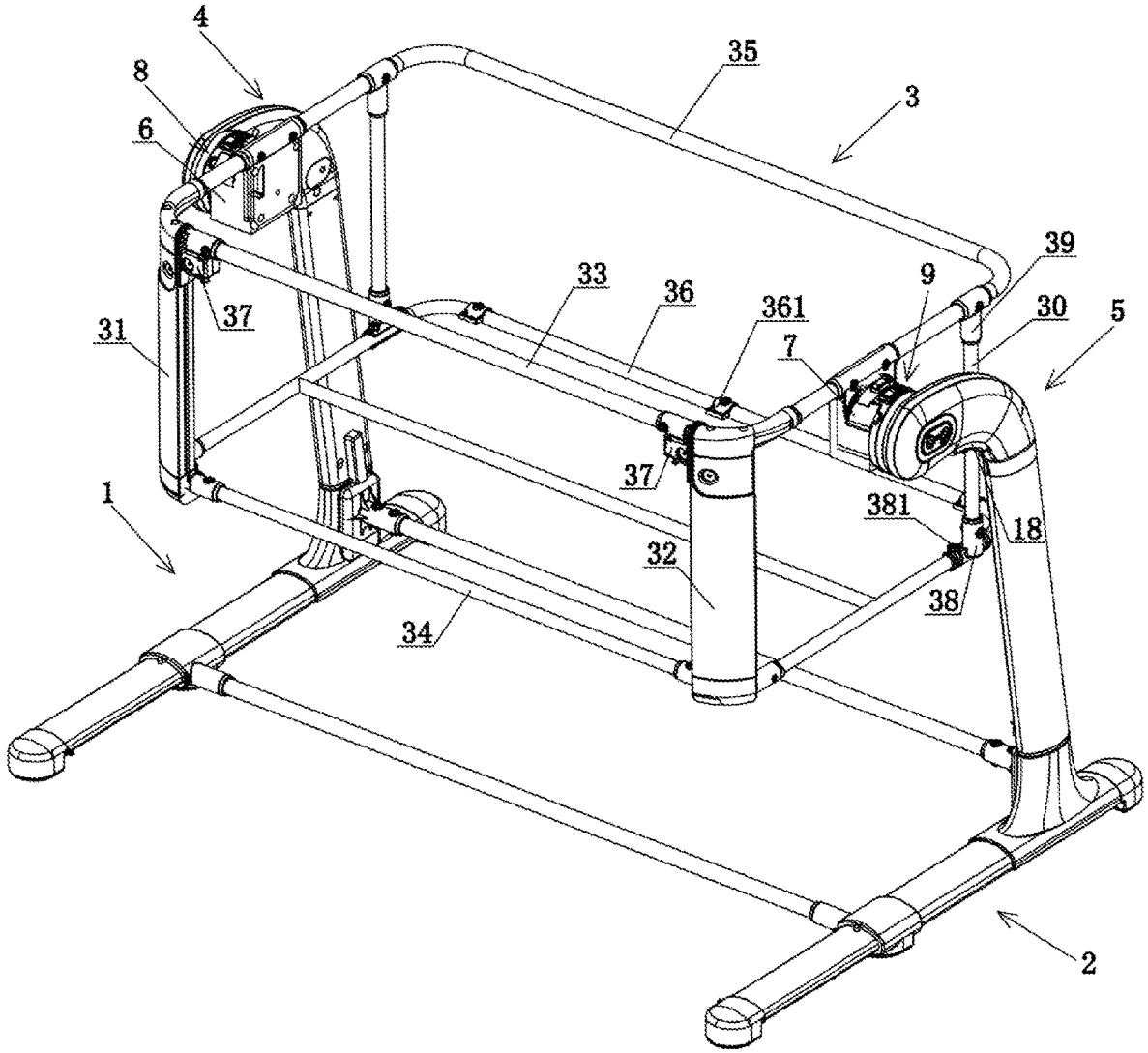
FIG. 3 is a view illustrating a structure after a rear cloth cover shown in FIG. 2 is removed.
Figure 4:
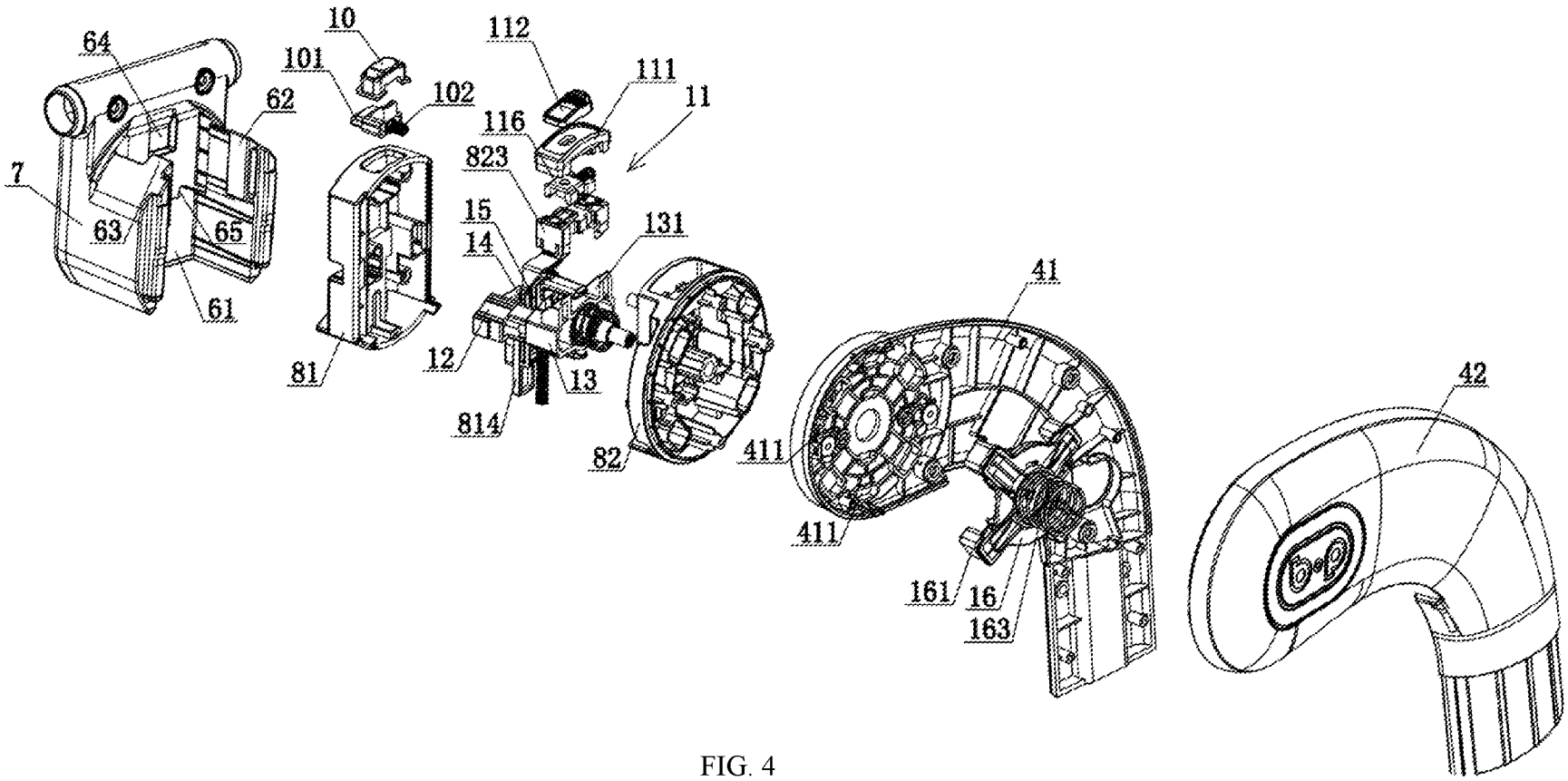
FIG. 4 is an exploded view illustrating structures of a right slider, a right fixed block and a right bending rod 5 according to the present invention.
Figure 5:
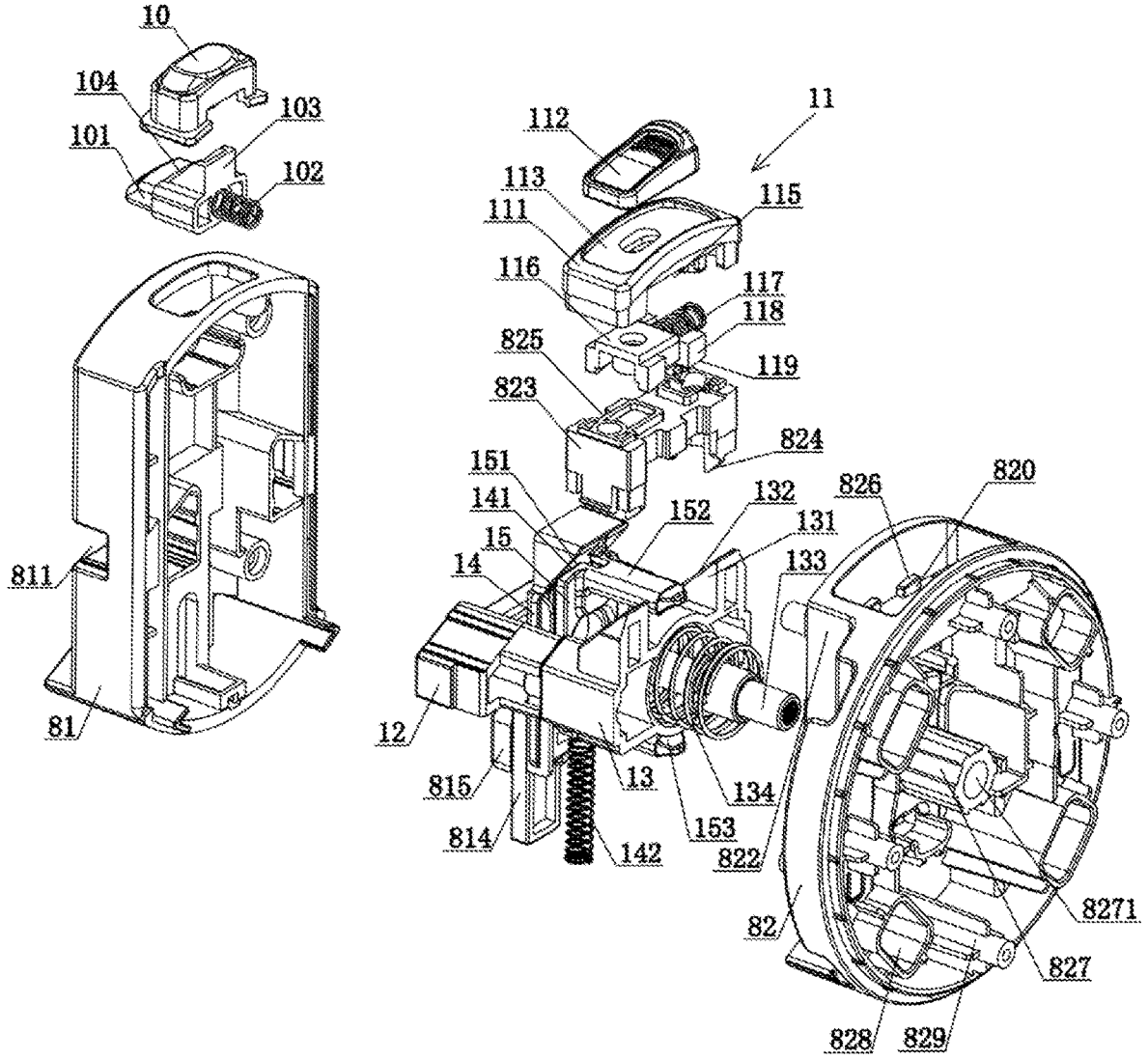
FIG. 5 is an exploded view illustrating a structure of the right fixed block according to the present invention.
Figure 6:
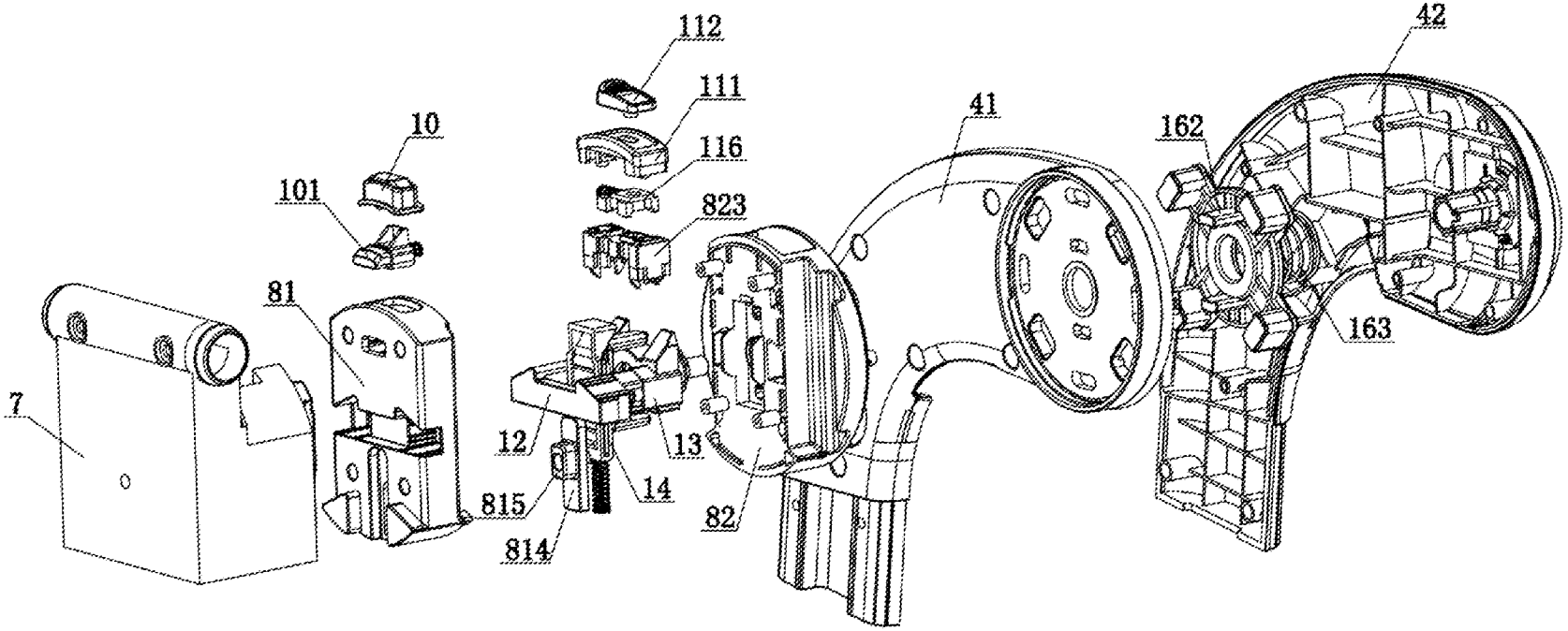
FIG. 6 is a view illustrating the structures shown in FIG. 4 from another perspective.

Referring to FIGS. 3 to 5, the left fixed block 8 and the right fixed block 9 respectively include an inner fixed block 81 and an outer fixed block 82 that are connected to each other. An outer side surface of the left slider 6 and an outer side surface of the right slider 7 are respectively provided with an opening 61. An entrance of the opening 61 is provided with a front guide bar 62 and a rear guide bar 63. An inner side surface of the outer fixed block 82 is provided with a front guide groove (not shown in the figure) and a rear guide groove 822 that are respectively adapted to the front guide bar 62 and the rear guide bar 63. The inner fixed block 81 is located in the opening 61, and is located inside the front guide bar 62 and the rear guide bar 63. The left bending rod 4 and the right bending rod 5 respectively include an inner bending shell 41 and an outer bending shell 42 that are connected to each other.

Referring to FIGS. 4 to 7, the separation button 10 is located in the top of the inner fixed block 81. A plug 101 is provided in the top of the inner fixed block 81. An inner end of the plug 101 extends out of an inner side surface of the inner fixed block 81. A first spring 102 is provided between an outer end of the plug 101 and the outer fixed block 82. An upper part of an inner end surface of the opening 61 is provided with a socket 64 for inserting the plug 101. The top of the plug 101 is provided with a first driving part 103. A top surface of the first driving part 103 is a first inclined surface 104 that is inclined inward and downward. The bottom of the separation button 10 is provided with a first pressing part 105. An outer side surface of the first pressing part 105 is provided with a second inclined surface 106 that fits the top surface of the first driving part 103. When the separation button 10 is pressed, the first pressing part 105 presses the first driving part 103 downward. Since the first inclined surface 104 and the second inclined surface 106 cooperate, the plug 101 is moved outward when the first pressing part 105 presses downward, such that the plug 101 is separated from the socket 64.

Referring to FIGS. 4 to 7, the inner side surface of the inner fixed block 81 is provided with a mounting groove 811. The mounting groove 811 is provided therein with a splayed clamping block 12. One end of the splayed clamping block 12 passes through the inner fixed block 81 and is connected to a connecting part 13. A top surface of the connecting part 13 is provided with second driving parts 131. The connecting part 13 and the second driving parts 131 are arranged in the outer fixed block 82 and are movable in left and right directions. Top surfaces of the second driving parts 131 are third inclined surfaces 132 that are inclined inward and downward. The swing button 11 is provided in an upper part of the outer fixed block 82. The swing button 11 includes a first button body 111 and a first sliding cover 112. A top surface of the first button body 111 is provided with a first sliding groove 113. The first sliding cover 112 is located in the first sliding groove 113. The bottom of the first sliding cover 112 is provided with a first connecting rod 114. The first button body 111 is provided with a first sliding space 115. The first sliding space 115 is provided therein with a first sliding part 116. A second spring 117 is provided between a side surface of the first sliding part 116 and a side surface of the first sliding space 115. The bottom of the first connecting rod 114 passes through the first button body 111 and is connected to the first sliding part 116. The outer fixed block 82 is provided therein with a second pressing part 823. An outer side surface of the second pressing part 823 is provided with a fourth inclined surface 824 that fits the top surfaces of the second driving parts 131. The first sliding part 116 is located above the second pressing part 823. A bottom surface of the first button body 111 abuts against a top surface of the second pressing part 823.

Referring to FIGS. 4 to 7, left and right side surfaces of the second pressing part 823 both are provided with two grooves 825 that are spaced apart. Left and right ends of a bottom surface of the first sliding part 116 both are provided with two protruding parts 118 that are spaced apart. The two protruding parts 118 correspond to two grooves 825 on the same side. The outer fixed block 82 is provided therein with two left clamping points 820 that are spaced apart and two right clamping points (not shown in the figure) that are spaced apart. The two left clamping points 820 are located in corresponding two grooves 825. The two right clamping points (not shown in the figure) are located in corresponding two grooves 825. Bottom surfaces of the protruding parts 118 are fifth inclined surfaces 119 that are inclined rearward and downward. Top surfaces of the left clamping points 820 and the right clamping points (not shown in the figure) are sixth inclined surfaces 826 that fit the fifth inclined surfaces 119. The inner end surface of the opening 61 is provided with a splayed clamping edge 65 that is adapted to and abuts against the splayed clamping block 12. The connecting part 13 is provided with a guide rod 133. The outer fixed block 82 is provided with a central shaft 827. The central shaft 827 is provided with a rod hole 8271 for the guide rod 133 to pass through. A third spring 134 is provided between the connecting part 13 and the outer fixed block 82.

Referring to FIGS. 4 to 7, the splayed clamping block 12 is shaped like a left square bracket "[" in a top view. The splayed clamping block 12 is provided therein with a vertical plate 14 and a pusher 15. A top outer side surface of the vertical plate 14 is a seventh inclined surface 141 that is inclined inward and downward. A rear top surface of the pusher 15 is an eighth inclined surface 151 that fits the seventh inclined surface. The pusher 15 is shaped like "[" in a left view. The pusher 15 is located at an outer end of the vertical plate 14. There are two second driving parts 131. The two second driving parts 131 are spaced apart in front and rear directions. A top transverse part 152 of the pusher 15 passes between the two second driving parts 131, and a bottom transverse part 153 of the pusher 15 is located below the connecting part 13. The top transverse part 152 and the bottom transverse part 153 of the pusher 15 pass through the outer fixed block 82. An inner end surface of the inner fixed block 81 is provided with a rod groove 812. The rod groove 812 is provided therein with a strip groove 813. A clamping rod 814 is provided in the rod groove 812. An inner end surface of the clamping rod 814 is provided with an abutting protrusion 815. An outer end surface of the clamping rod 814 is provided with a connecting bar 816. The connecting bar 816 passes through the strip groove 813 and is connected to the bottom of the vertical plate 14. The vertical plate 14 and the pusher 15 are located in the inner fixed block 81. A fourth spring 142 is provided between the bottom of the vertical plate 14 and an inner bottom surface of the inner fixed block 81. A movable member 16 is provided between the inner bending shell 41 and the outer bending shell 42. An outer periphery of the movable member 16 is evenly provided with multiple clamping parts 161. An outer end of the outer fixed block 82 is provided with multiple clamping grooves 828. Each clamping groove 828 corresponds to one clamping part 161. The multiple clamping parts 161 pass through the inner bending shell 41 and are clamped in the corresponding clamping grooves 828. An inner end surface of the movable member 16 is provided with two abutting rods 162. The top transverse part 152 and the bottom transverse part 153 of the pusher 15 respectively correspond to the abutting rods 162. The two abutting rods 162 pass through the inner bending shell 41 and are located in the outer fixed block 82. A fifth spring 163 is provided between the movable member 16 and the outer bending shell 42. An outer end of the outer fixed block 82 is evenly provided with multiple limit rods 829. The inner bending shell 41 is evenly provided with multiple arc through holes 411. Each limit rod 829 corresponds to one arc through hole 411, and each limit rod 829 passes through the corresponding arc through hole 411. The guide rod 133 passes through the inner bending shell 41.

Figure 8:
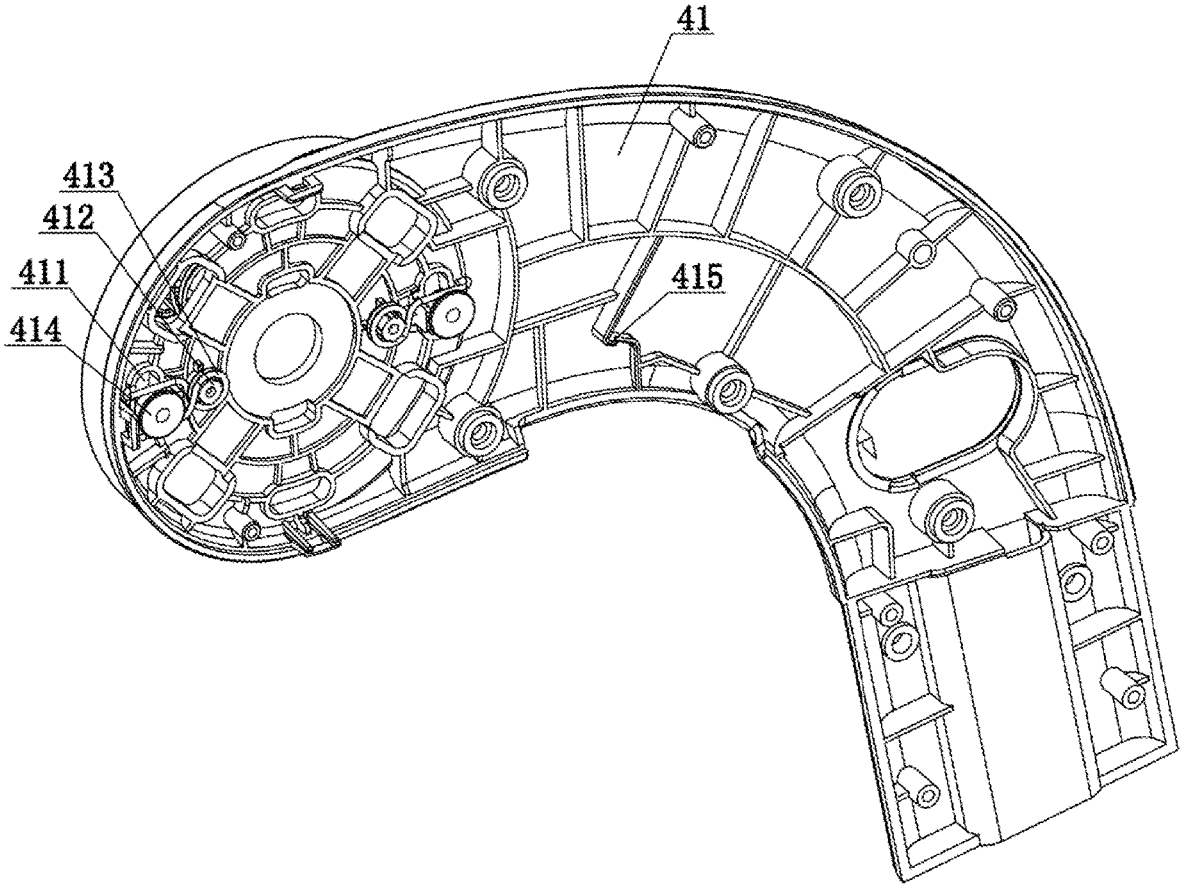
FIG. 8 is a view illustrating a structure of an inner bending shell according to the present invention.

Referring to FIGS. 5 and 8, an outer end of the inner bending shell 41 is provided with two symmetrical sleeve posts 412, two symmetrical centering springs 413 and two symmetrical connecting members 414. Each centering spring 413 corresponds to one sleeve post 412 and one connecting member 414. One end of the centering spring 413 is sleeved on the sleeve post 412, and the other end of the centering spring 413 is clamped on the connecting member 414. The two connecting members 414 respectively correspond to one arc through hole 411. Inner ends of the connecting members 414 are connected to the corresponding limit rods 829.

Referring to FIGS. 1 to 8, to turn the sleeping basket frame 3 into a cradle, the separation button 10 on the left fixed block 8 is pressed to separate the plug 101 from the socket 64, and the first sliding cover 112 of the swing button 11 is pushed to make the left clamping points 820 and the right clamping points (not shown in the figure) misaligned with the corresponding protruding parts 118. Then, the first button body 111 pushing the swing button 11 is pressed. When the first button body 111 is pressed downward, the first sliding part 116 presses the second pressing part 823 downward. Since the third inclined surface 132 and the fourth inclined surface 824 cooperate, when the second pressing part 823 is pressed down, the connecting part 13 is driven to move outward. When the connecting part 13 is moved outward, the splayed clamping block 12 is also driven to move outward, such that the splayed clamping block 12 is separated from the splayed clamping edge 65. Thus, the left slider 6 descends. When the left slider 6 descends, the splayed clamping edge 65 presses the abutting protrusion 815 downward, thereby driving the vertical plate 14 to descend. Due to the cooperation of the seventh inclined surface 141 and the eighth inclined surface 151, the pusher 15 is driven to move outward when the vertical plate 14 descends. When the pusher 15 is moved outward, the top transverse part 152 and the bottom transverse part 153 respectively push the corresponding abutting rods 162 to move outward, such that the movable member 16 is moved outward. When the movable member 16 is moved outward, the multiple clamping parts 161 are separated from the corresponding clamping grooves 828. The multiple limit rods 829 are in a swing state relative to the corresponding circular arc through holes 411, that is, the left slider 6 and the left fixed block 8 are in a swing state relative to the left bending rod 4. In the same way, by operating the separation button 10 and the swing button 11 on the right fixed block 9 according to the above-mentioned method, the right slider 7 and the right fixed block 9 are in a swing state relative to the right bending rod 5. Thus, the sleeping basket frame swings based on an arc set by the arc through holes 411. For example, when the sleeping basket frame 3 does not need to swing, the sleeping basket frame 3 is directly pulled upward, such that the plug 101 is inserted into the socket 64, the splayed clamping edge 65 is clamped on the splayed clamping block 12, and the multiple clamping parts 161 are clamped into the corresponding clamping grooves 828. The first spring 102, the second spring 117, the third spring 134, the fourth spring 142 and the fifth spring 163 are provided to realize the automatic return of the plug 101, the first sliding part 116, the connecting part 13, the vertical plate 14 and the movable member 16, respectively.

Figure 7:
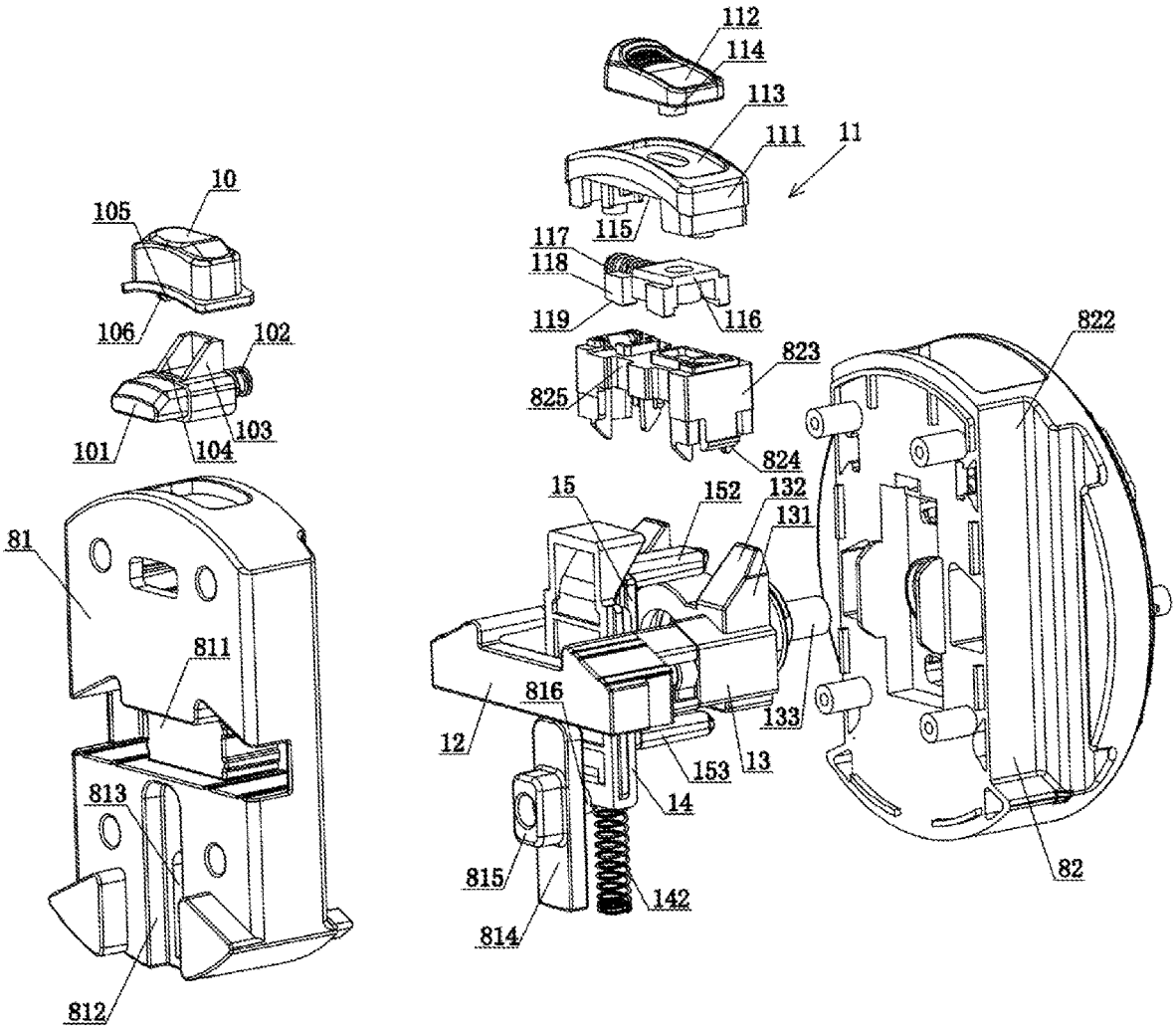
FIG. 7 is a view illustrating the structure shown in FIG. 5 from another perspective.

Referring to FIGS. 5 and 7, it should be noted that when the swing button 11 is operated, the first sliding cover 112 needs to be pushed first, such that the left clamping points 820 and the right clamping points (not shown in the figure) are misaligned with the corresponding protruding parts 118. Otherwise, the first button body 111 cannot be pressed downward. This operation also provides a double-lock function for the swing button 11. The bottom surfaces of the protruding parts 118 are fifth inclined surfaces 119 that are inclined rearward and downward, and the top surfaces of the left clamping points 820 and the right clamping points (not shown in the figure) are sixth inclined surfaces 826 that fit the fifth inclined surfaces 119. The fifth inclined surfaces 119 and the sixth inclined surfaces 826 are provided to prevent the first sliding part 116 from moving when the first button body 111 is directly pressed downward without pushing the first sliding cover 112. The centering springs 413 enable the left slider 6 and the left fixed block 8 to have an automatic centering function relative to the left bending rod 4, and enable the right slider 7 and the right fixed block 9 to have an automatic centering function relative to the right bending rod 5.

Figure 9:
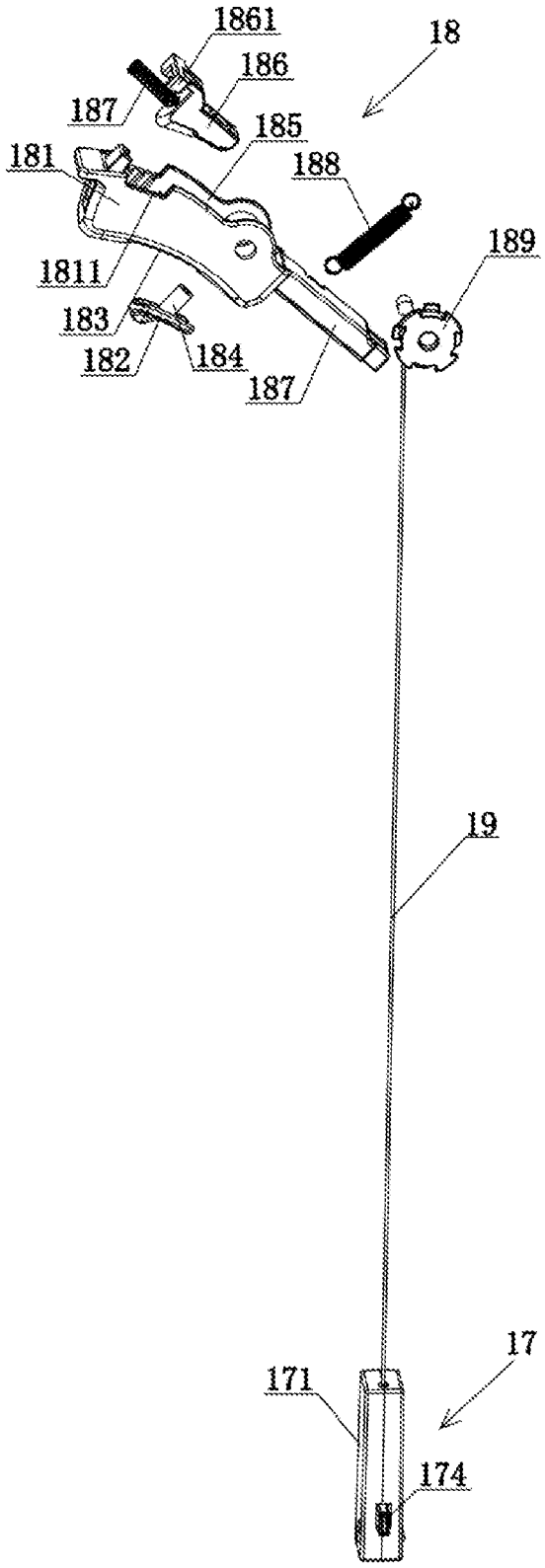
FIG. 9 is a view illustrating a clamping device and a lift button that are connected, where the lift button is shown in an exploded view, according to the present invention.
Figure 12:
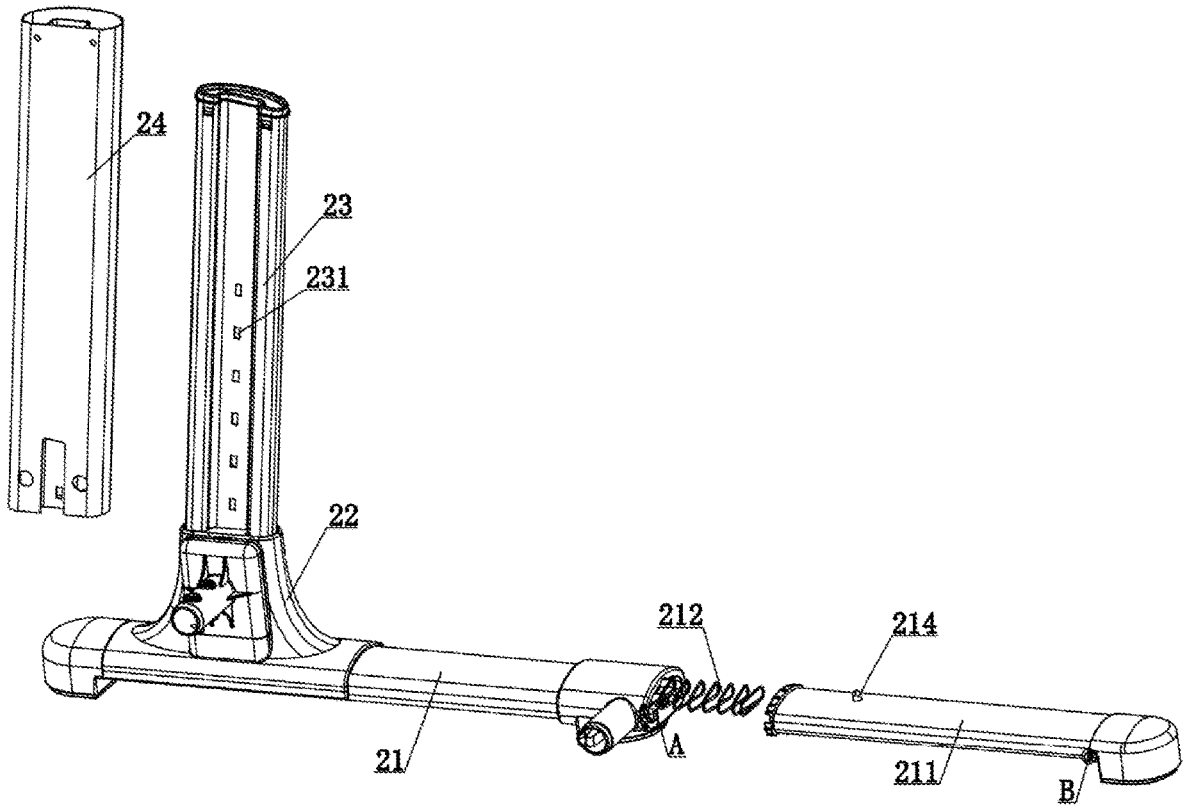
FIG. 12 is an exploded view illustrating a structure of a right support frame according to the present invention.
Figure 13:
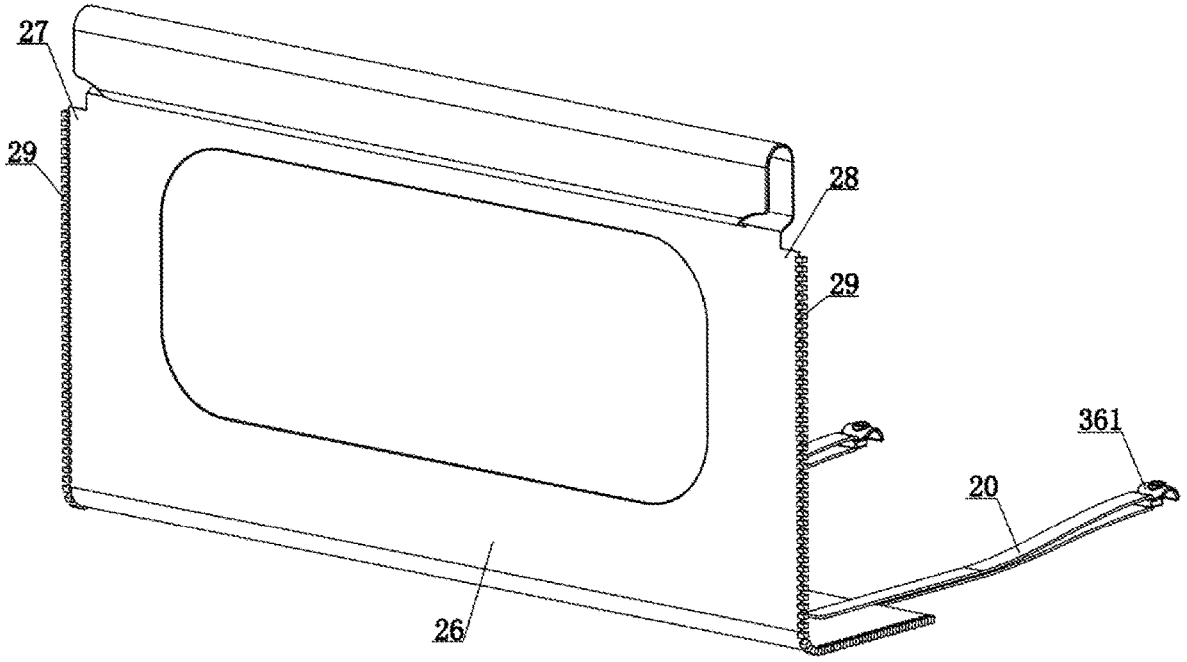
FIG. 13 is a view illustrating a structure of the rear cloth cover according to the present invention.
Figure 14:
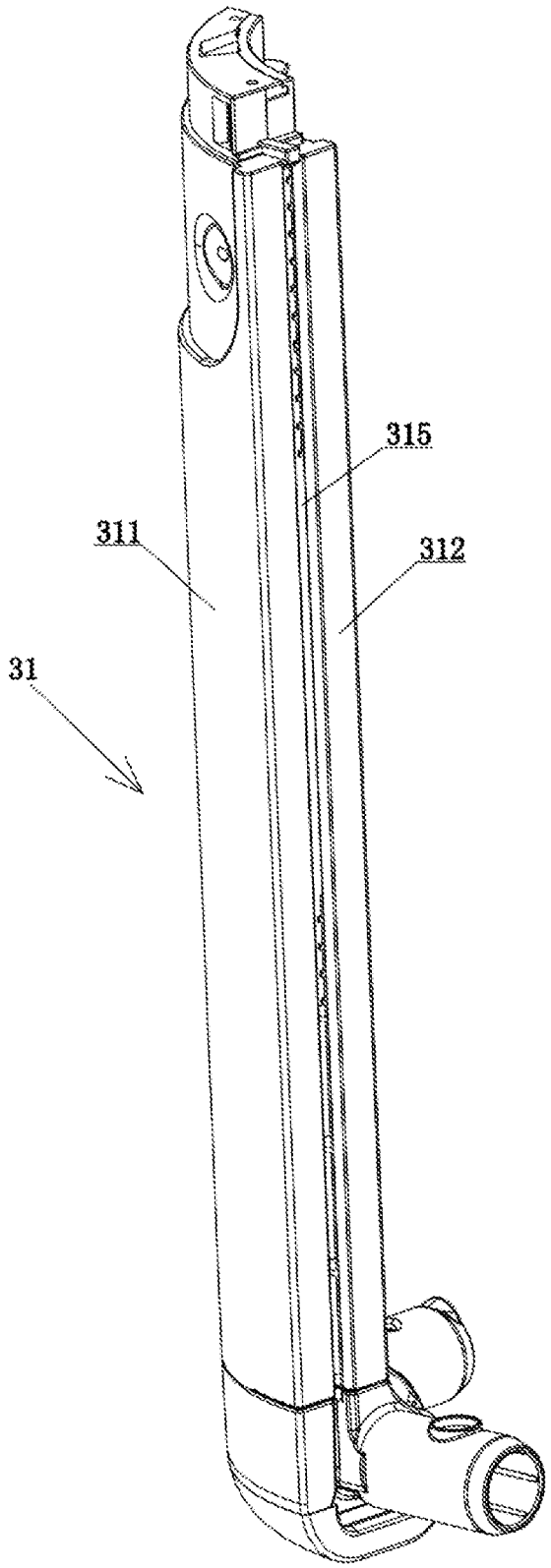
FIG. 14 is a view illustrating a structure of a left guide rail according to the present invention.
Figure 15:
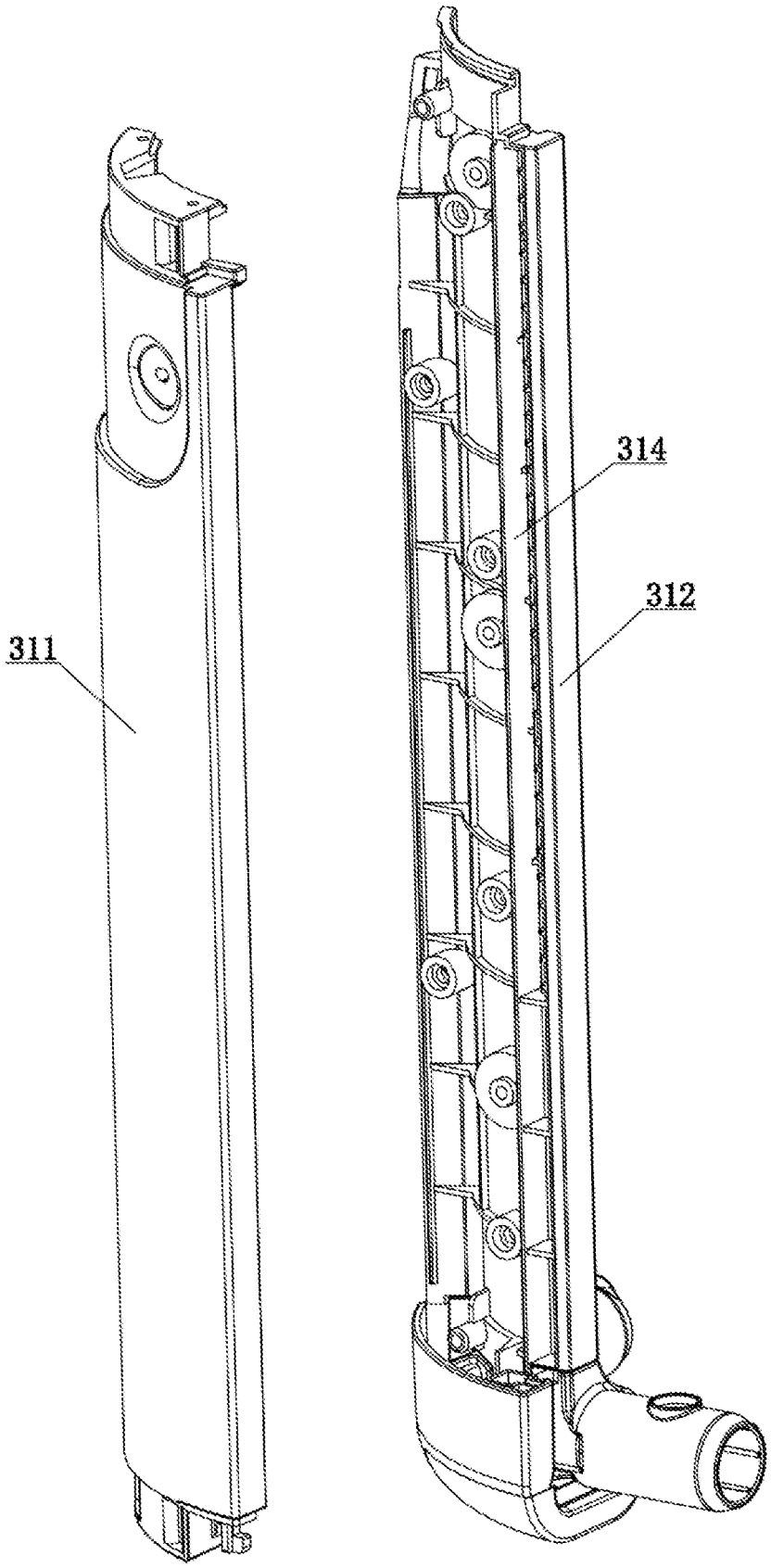
FIG. 15 is an exploded view illustrating a structure of the left guide rail according to the present invention.
Figure 16:
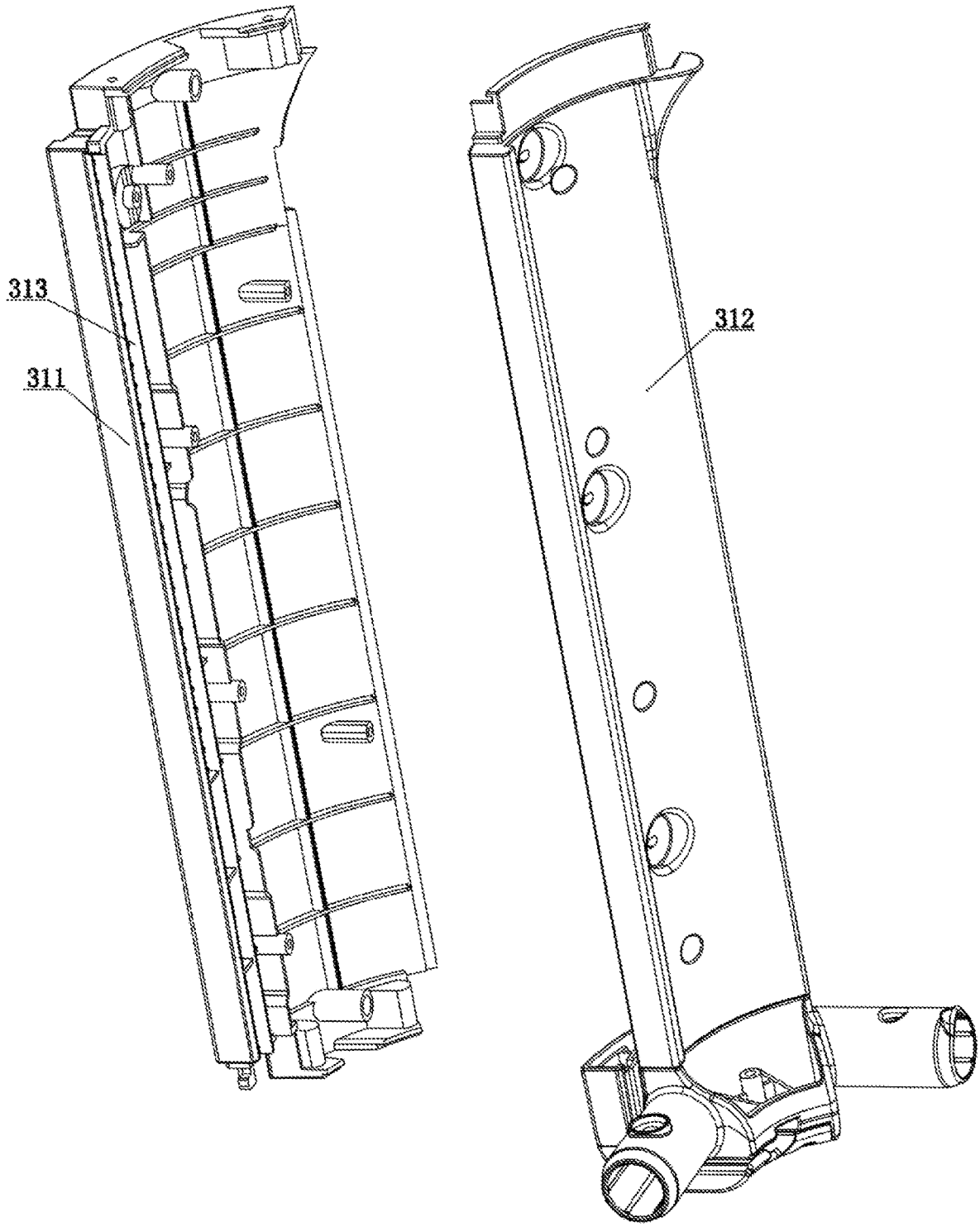
FIG. 16 is an exploded view illustrating a structure of the left guide rail from another perspective according to the present invention.
Figure 17:
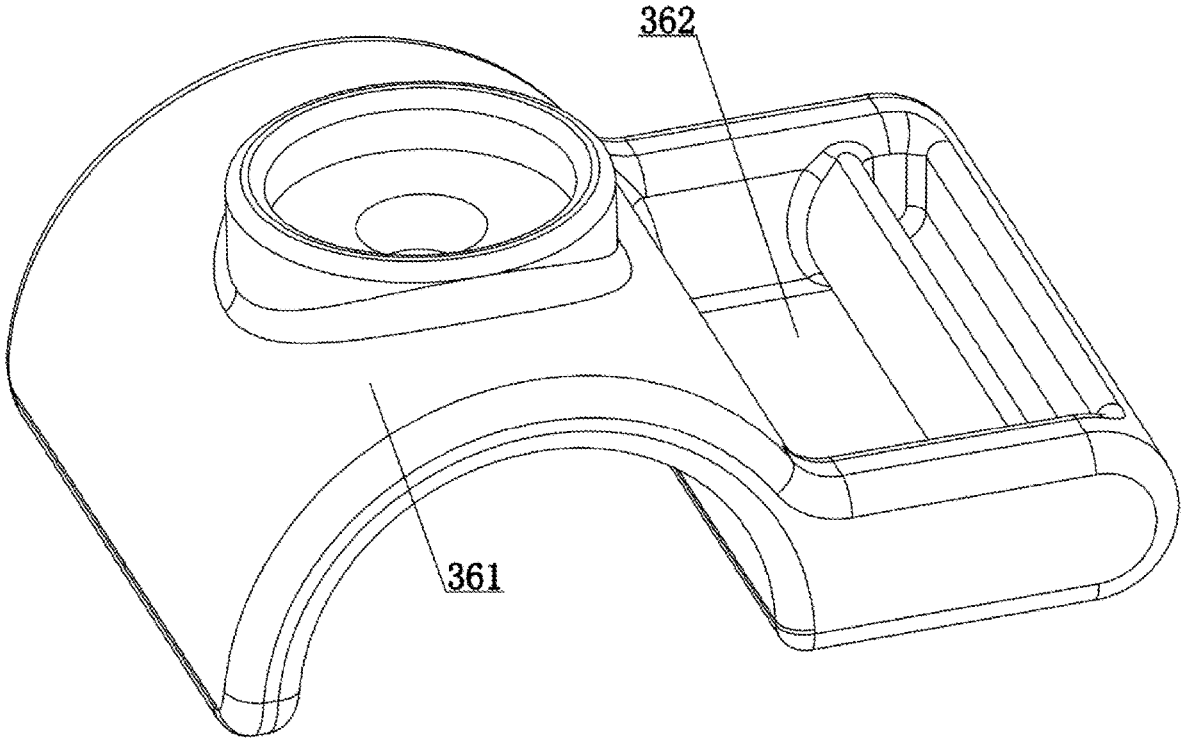
FIG. 17 is a view illustrating a structure of a winding member according to the present invention.
Figure 18:
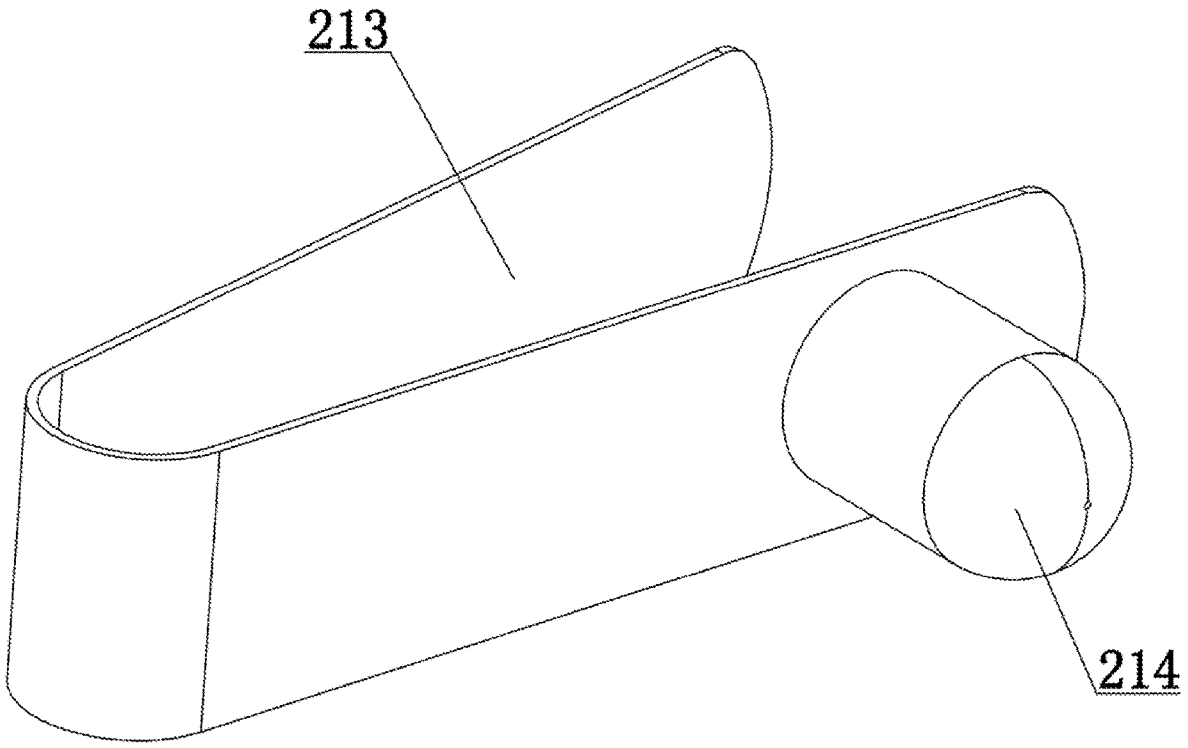
FIG. 18 is a view illustrating a structure of a V-shaped elastic piece according to the present invention.
Figure 19:
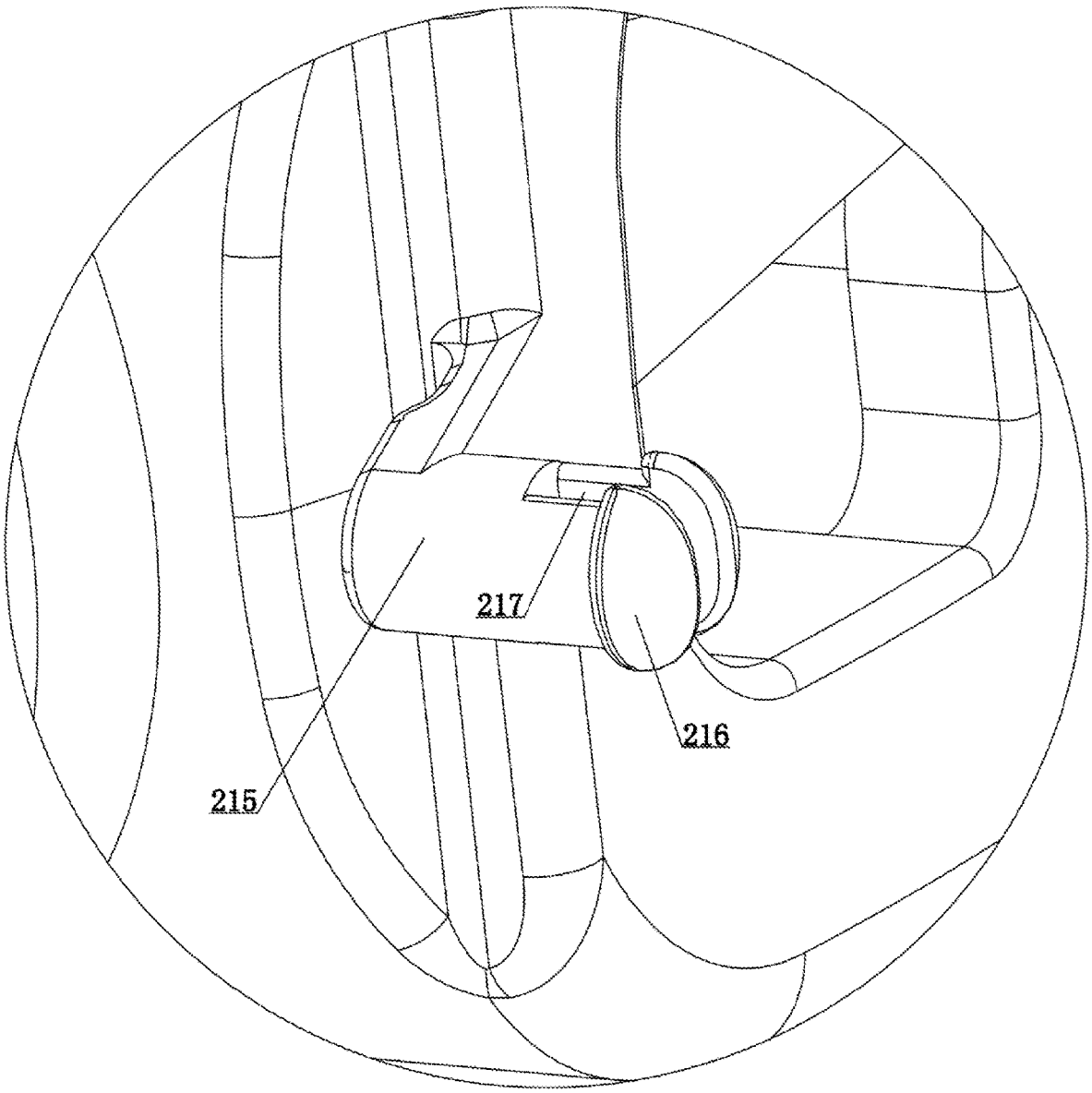
FIG. 19 is a partial enlarged view of A in FIG. 12.
Figure 20:
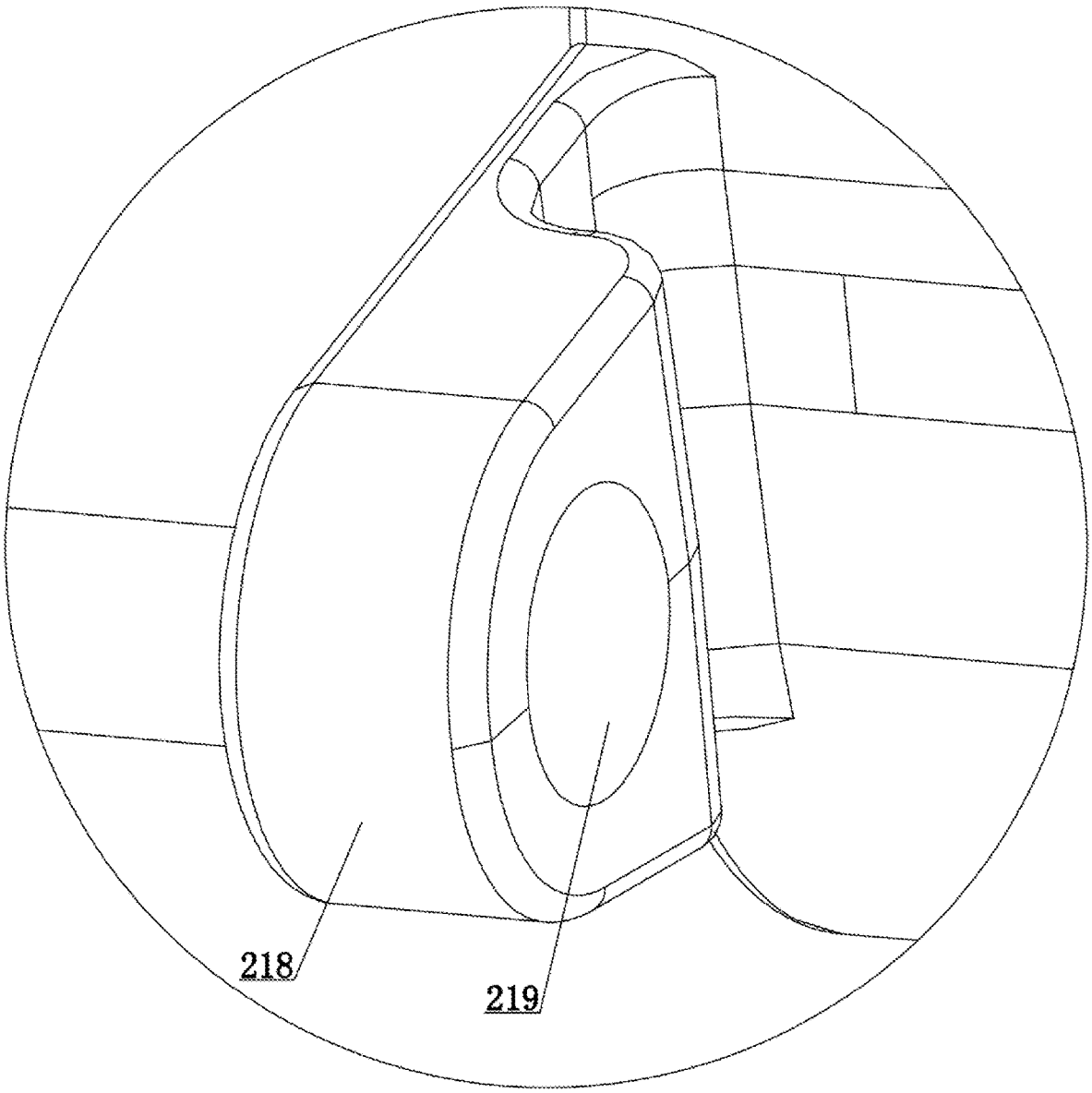
FIG. 20 is a partial enlarged view of B in FIG. 12.

Referring to FIGS. 1, 9 and 12, the left support frame 1 and the right support frame 2 respectively include a support sleeve 21, a support base 22, a support rod 23 and a sleeve rod 24. The bottom of the support base 22 is connected to the support sleeve 21. The bottom of the support rod 23 is connected to the top of the support base 22. The sleeve rod 24 is sleeved on the support rod 23, and the sleeve rod 24 is able to ascend and descend relative to the support rod 23. The bottom of the sleeve rod 24 is provided with a clamping device 17 for adjusting the height of the sleeve rod. The left bending rod 4 and the right bending rod 5 are respectively provided with a lift button 18 for pulling the clamping device 17 up and down. A pull rope 19 is provided between the lift button 18 and the clamping device 17. The bottom of the lift button 18 extends out of the bottom of the corresponding left bending rod 4 or right bending rod 5. The sleeve rod 24 is connected to the corresponding left bending rod 4 or right bending rod 5.

Referring to FIGS. 4, 8 and 9, the lift button 18 includes a second button body 181 and a second sliding cover 182. A bottom surface of the second button body 181 is provided with a second sliding groove 183. The second sliding cover 182 is located in the second sliding groove 183. The top of the second sliding cover 182 is provided with a second connecting rod 184. The second button body 181 is provided therein with a second sliding space 185. The second sliding space 185 is provided with therein a second sliding part 186. A sixth spring 187 is provided between one end of the second sliding part 186 and one end of the second sliding space 185. The top of the second connecting rod 184 passes through the second button body 181 and is connected to the second sliding part 186. The second button body 181 is hinged to the inner bending shell 41 and the outer bending shell 42. The other end of the second button body 181 is provided with a pull rod 187. A seventh spring 188 is provided between the pull rod 187 and an upper part of the inner bending shell 41. A winding wheel 189 is provided in the inner bending shell 41. One end of the pull rope 19 is connected to the bottom of the pull rod 187, and the other end of the pull rope 19 is wound around the winding wheel 189 and is connected to the clamping device 17. A top surface of the second button body 181 is provided with two symmetrical limit cuts 1811. Inner and outer ends of the second sliding part 186 are respectively provided with extending parts 1861 that abut against the corresponding limit cuts 1811. The inner bending shell 41 is provided therein with an abutting part 415 extending outward. When the second sliding part 186 is in a non-sliding state, a top surface of the second sliding part abuts against the abutting part 415.

Figure 10:
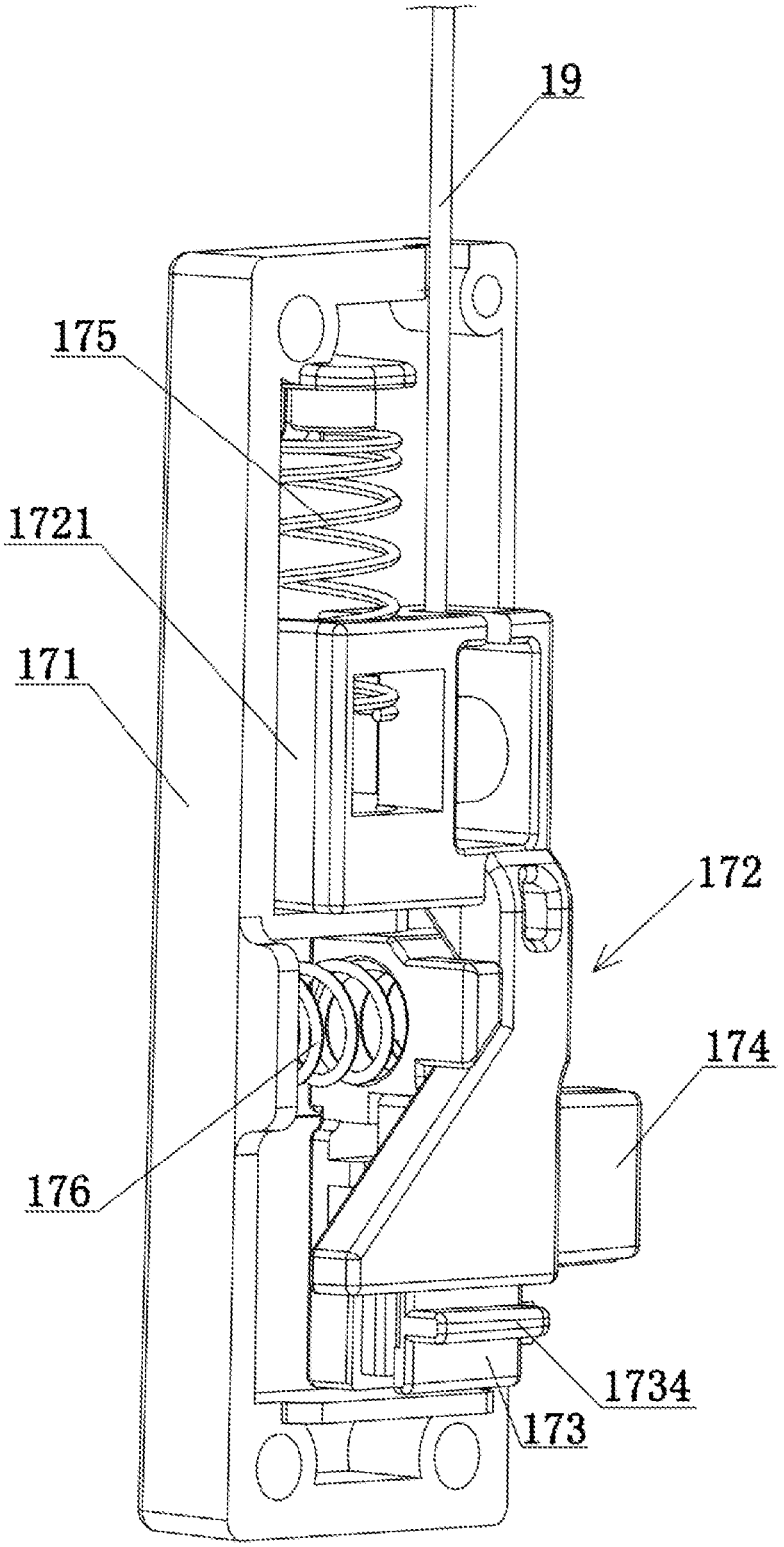
FIG. 10 is a view illustrating a structure of the clamping device after part of a casing is removed according to the present invention.
Figure 11:
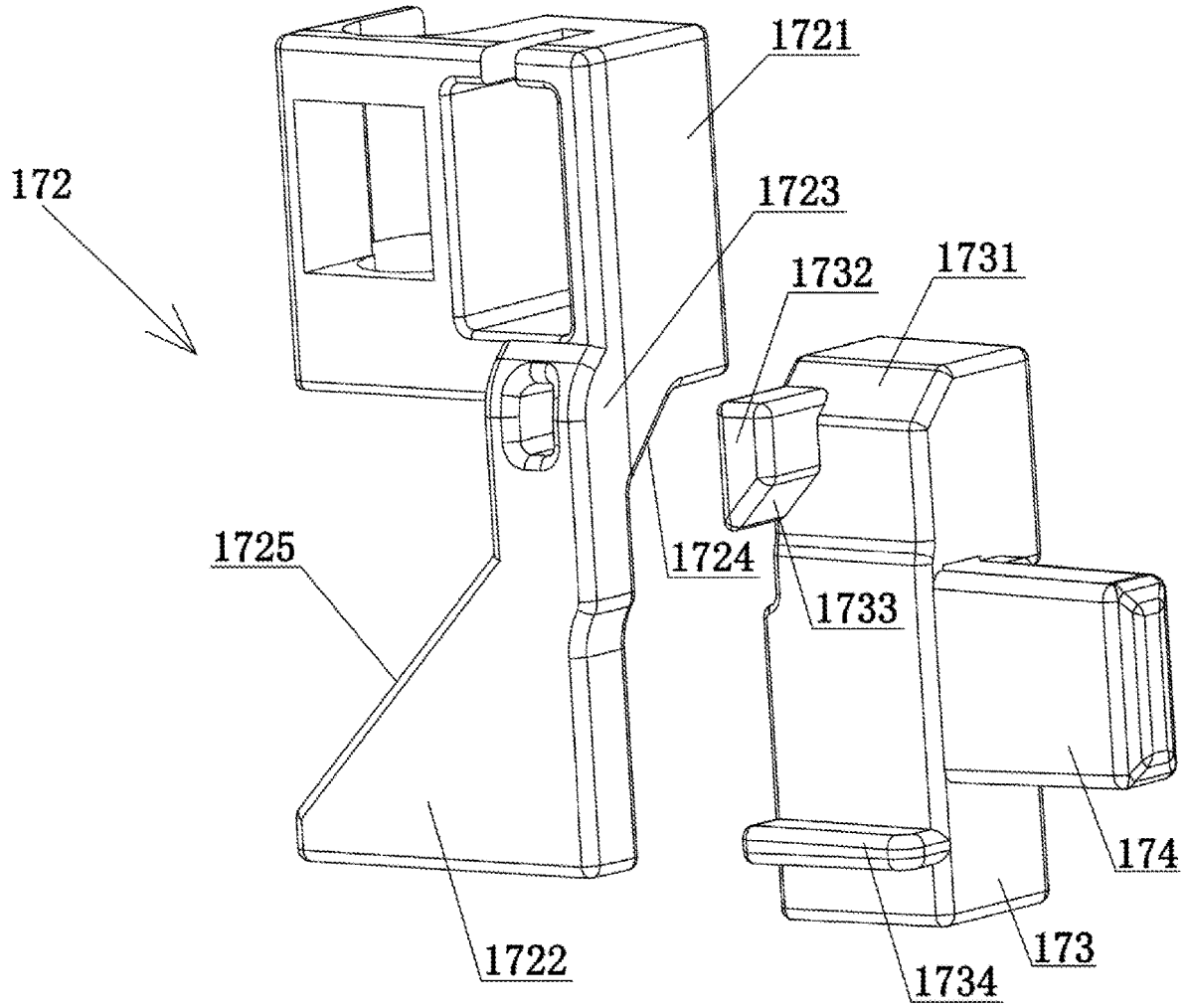
FIG. 11 is an exploded view illustrating structures of a lifting block and a clamping block according to the present invention.

Referring to FIGS. 9 to 11, the clamping device 17 includes a casing 171, a lifting block 172 and a clamping block 173. The casing 171 is fixedly provided at the bottom of the sleeve rod 24. The lifting block 172 and the clamping block 173 are arranged in the casing 171. The lifting block 172 is used to drive the clamping block 173 to move in left and right directions. An outer side surface of the clamping block 173 is provided with a clamping plate 174. An inner side surface of the support rod 23 is provided with multiple clamping openings 231 that are spaced apart vertically for one end of the clamping plate 174 to be clamped into. The bottom of the pull rope 19 is connected to the lifting block 172. An eighth spring 175 is provided between a top surface of the lifting block 172 and an inner top surface of the casing 171. The lifting block 172 includes a head part 1721 and a third driving part 1722. A junction of the head part 1721 and the third driving part 1722 is a bending part 1723. A front side surface of the bending part 1723 is a ninth inclined surface 1724. Atop surface of the clamping block 173 is a tenth inclined surface 1731 that fits the ninth inclined surface 1724. A protrusion 1732 is provided on a top inner side surface of the clamping block 173. A bottom surface of the protrusion 1732 is an eleventh inclined surface 1733. An outer side surface of the protrusion 1732 abuts against an inner side surface of the third driving part 1722. The inner side surface of the third driving part 1722 is provided with a twelfth inclined surface 1725 that fits the eleventh inclined surface 1733. A ninth spring 176 is provided between an inner side surface of the clamping block 173 and an inner side surface of the casing 171. A lower rear side surface of the clamping block 173 is provided with a limit plate 1734. The limit plate 1734 is located below the third driving part 1722.

Referring to FIGS. 1 and 9 to 12, when the sleeve rod 24 needs to ascend and descend, the second sliding cover 182 is first pushed to make the second sliding part 186 and the abutting part 415 misaligned. Then, the second button body 181 is pressed to lift the pull rope 19, such that the pull rope 19 lifts the lifting block 172. Due to the cooperation of the ninth inclined surface 1724 and the tenth inclined surface 1731 and the cooperation of the eleventh inclined surface 1733 and the twelfth inclined surface 1725, when the lifting block 172 ascends, the clamping block 173 is driven to move inward, such that the clamping plate 174 is separated from the original matching clamping opening 231. In this way, the sleeve rod 24 can ascend and descend, such that the sleeping basket frame 3, the left bending rod 4 and the right bending rod 5 can ascend and descend as a whole. When the sleeve rod 24 ascends to a proper position, the second button body 181 and the second sliding cover 182 are released. The pull rope 19 descends back to the position, and the lifting block 172 descends to drive the clamping block 173 to move outward, such that the clamping plate 174 is clamped into a new clamping opening 231. It should be noted that the second sliding cover 182 needs to be pushed before the second button body 181 is pressed. If the second sliding cover 182 is not pushed first, the top surface of the second sliding part 186 will abut against the abutting part 415, and the second button body 181 cannot be pressed. Therefore, the lift button 18 also has a double-lock function.

Referring to FIG. 3, the sleeping basket frame 3 includes a left guide rail 31, a right guide rail 32, a lifting tube 33, a bottom rod 34, an upper bending tube 35 and a lower bending tube 36. The upper bending tube 35 is provided between a top front end of the left guide rail 31 and a top front end of the right guide rail 32. The lower bending tube 36 is provided between a bottom front end of the left guide rail 31 and a bottom front end of the right guide rail 32. The bottom rod 34 is provided between a bottom inner side of the left guide rail 31 and a bottom inner side of the right guide rail 32. An inner side surface of the left guide rail 31 and an inner side surface of the right guide rail 32 are respectively provided with a lifting member 37. The lifting tube 33 is provided between the lifting member 37 of the left guide rail 31 and the lifting member 37 of the right guide rail 32. The lifting member 37 is an existing structure, and the connection manner between the lifting member and the left guide rail 31 as well as the right guide rail 32 is an existing connection manner, which will not be repeated here. The lower bending tube 36 is provided with two symmetrical lower tube sleeves 38. The upper bending tube 35 is provided with two symmetrical upper tube sleeves 39. Each lower tube sleeve 38 corresponds to one upper tube sleeve 39. A reinforcing rod 30 is provided between the corresponding upper tube sleeve 39 and lower tube sleeve 38. The bottoms of the two lower tube sleeves 38 are respectively provided with a sleeve 381 with an open structure inside. The sleeve 381 is sleeved on the lower bending tube 36. The left slider 6 and the right slider 7 are connected to the upper bending tube 35. The sleeve 381 is rotatable relative to the lower bending tube 36. During assembly, the reinforcing rod 30 can be rotated and folded along with the sleeve 381 relative to the lower bending tube 36.

Referring to FIGS. 1 to 3 and 13 to 17, the cloth cover includes a front cloth cover 25 and a rear cloth cover 26. The front cloth cover 25 is connected to the upper bending tube 35 and the lower bending tube 36. An upper part of the rear cloth cover 26 is sleeved on the lifting tube 33. A left end and a right end of the rear cloth cover 26 are respectively provided with a left zipper belt 27 and a right zipper belt 28. The left zipper belt 27 and the right zipper belt 28 are respectively provided with zipper teeth 29. The left guide rail 31 and right guide rail 32 are respectively provided with a hollow structure. The left guide rail 31 and the right guide rail 32 both include a front guide shell 311 and a rear guide shell 312 that are connected to each other. A front partition 313 is provided in the front guide shell 311, and a rear partition 314 is provided in the rear guide shell 312. A first through hole 315 from top to bottom is formed on an inner side surface after the front guide shell 311 and the rear guide shell 312 are connected. A second through hole (not shown in the figure) from top to bottom is formed between the front partition 313 and the rear partition 314 after the front guide shell 311 and the rear guide shell 312 are connected. The left zipper belt 27 and the right zipper belt 28 pass through the corresponding first through hole 315 and second through hole (not shown in the figure). The zipper teeth 29 of the left zipper belt 27 and the zipper teeth 29 of the right zipper belt 28 are respectively located in the left guide rail 31 and the right guide rail 32. The zipper teeth 29 of the left zipper belt 27 block an outer side of the front partition 313 and the rear partition 314 in the left guide rail 31. The zipper teeth 29 of the right zipper belt 28 block an outer side of the front partition 313 and the rear partition 312 in the right guide rail 32. The bottom of the rear cloth cover 26 is wound around the bottom of the bottom rod 34. The bottom of the rear cloth cover 26 is provided with multiple elastic belts 20. A front end of the lower bending tube 36 is provided with multiple winding members 361. Each winding member 361 corresponds to one elastic belt 20. Each winding member 361 is provided with a winding hole 362. One end of each elastic belt 20 is connected to one side surface of the bottom of the rear cloth cover 26. The other end of each elastic belt 20 passes through the corresponding winding hole 362 and is connected to the other side surface of the bottom of the rear cloth cover 26.

Referring to FIGS. 1 to 3 and 13 to 17, the left zipper belt 27, the right zipper belt 28 and the zipper teeth 29 make the connection of the rear cloth cover 26 to the left guide rail 31 and the right guide rail 32 easier. The zipper teeth 29 of the left zipper belt 27 block the outer side of the front partition 313 and the rear partition 314 in the left guide rail 31, and the zipper teeth 29 of the right zipper belt 28 block the outer side of the front partition 313 and the rear partition 314 of the right guide rail 32. In this way, the zipper teeth 29 can only be located in the corresponding left guide rail 31 and right guide rail 32, so as to ensure that the rear cloth cover 26 does not fall off the left guide rail 31 and the right guide rail 32. To lower the rear cloth cover 26 down, the lifting member 37 of the left guide rail 31 and the lifting member 37 of the right guide rail 32 are separated from the corresponding left guide rail 31 and right guide rail 32. Pulled by the multiple elastic belts 20, the rear cloth cover 26 and the lifting tube 33 descend, and the bottom of the rear cloth cover 26 is moved rearward accordingly.

Referring to FIGS. 12, 18, 19 and 20, a telescopic inner tube 211 is provided in a rear end of the support sleeve 21. A compression spring 212 is provided in the support sleeve 21 along a length direction. A front end of the inner tube 211 is provided therein with a V-shaped elastic piece 213. A top surface of the V-shaped elastic piece 213 is provided with a clamping bead 214. A rear top surface of the inner tube 211 is provided with a clamping hole for the clamping bead 214 to extend outward. The clamping bead 214 is located on a rear side of the support sleeve 21. The rear end of the support sleeve 21 is provided with a connecting post 215 that is L-shaped in a top view. An end of the connecting post 215 is provided with a frustum part 216. A transverse part of the connecting post 215 is provided with a slit 217. The slit 217 respectively divides the transverse part and the frustum part 216 of the connecting post 215 into two halves. The rear end of the support sleeve 21 is provided with a lug 218. The lug 218 is provided with a circular hole 219 for inserting the two halves of the frustum part 216.

Referring to FIGS. 12, 18, 19 and 20, the inner tube 211 is telescopic within the support sleeve 21, which can reduce the packaging size. When the inner tube needs to be used, it is directly extended until the clamping bead 214 is clamped into the clamping hole. When the inner tube 211 is retracted, the two halves of the frustum part 216 can be inserted into the circular hole 219 and pass through a rear side surface of the circular hole 219, which minimizes the packaging size and makes the inner tube 211 and the support sleeve 21 connected firmly.

The above description are merely specific implementations of the present invention, but the design concept of the present invention is not limited thereto. Any non-substantial changes made to the present invention based on the concept of the present invention should fall within the protection scope of the present invention.

What is claimed is:

1. A safe bassinet, comprising a left support frame, a right support frame and a sleeping basket frame, wherein a top of the left support frame and a top of the right support frame are respectively provided with a left bending rod and a right bending rod;

the sleeping basket frame is provided between the left bending rod and the right bending rod;

the sleeping basket frame is covered with a cloth cover;

a left end and a right end of the sleeping basket frame are respectively provided with a left slider and a right slider;

a right end of the left bending rod and a left end of the right bending rod are respectively, provided with a left fixed block and a right fixed block;

the left slider and the right slider are respectively slidable up and down relative to the left fixed block and the right fixed block;

the left bending rod and the right bending rod are respectively rotatably connected to the left fixed block and the right fixed block;

top surfaces of the left fixed block and the right fixed block both are provided with a separation button and a swing button;

the separation buttons drive the left fixed block and the right fixed block to be separated from the corresponding left slider and right slider, respectively;

the swing buttons drive the left fixed block and the right fixed block to descend to be separated from the corresponding left slider and right slider, respectively; and the swing buttons drive the left fixed block and the right fixed block to swing with the corresponding left bending rod and right bending rod, respectively.

2. The safe bassinet according to claim 1, wherein the left fixed block and the right fixed block respectively comprise an inner fixed block and an outer fixed block, wherein the inner fixed block and the outer fixed block are connected to each other;

an outer side surface of the left slider and an outer side surface of the right slider are respectively provided with an opening;

an entrance of the opening is provided with a front guide bar and a rear guide bar;

an inner side surface of the outer fixed block is provided with a front guide groove and a rear guide groove, wherein the front guide groove and the rear guide groove are respectively adapted to the front guide bar and the rear guide bar;

the inner fixed block is located in the opening, and is located inside the front guide bar and the rear guide bar; and the left bending rod and the right bending rod respectively comprise an inner bending shell and an outer bending shell, wherein the inner bending shell and the outer bending shell are connected to each other.

3. The safe bassinet according to claim 2, wherein the separation button is located in a top of the inner fixed block; a plug is provided in the top of the inner fixed block;

an inner end of the plug extends out of an inner side surface of the inner fixed block;

a first spring is provided between an outer end of the plug and the outer fixed block;

an upper part of an inner end surface of the opening is provided with a socket for inserting the plug;

a top of the plug is provided with a first driving part;

a top surface of the first driving part is a first inclined surface inclined inward and downward;

a bottom of the separation button is provided with a first pressing part; and an outer side surface of the first pressing part is provided with a second inclined surface fitting the top surface of the first driving part.

4. The safe bassinet according to claim 3, wherein the inner side surface of the inner fixed block is provided with a mounting groove;

the mounting groove is provided therein with a splayed clamping block;

one end of the splayed clamping block passes through the inner fixed block and is connected to a connecting part;

a top surface of the connecting part is provided with second driving parts;

the connecting part and the second driving parts are arranged in the outer fixed block and are movable in left and right directions;

top surfaces of the second driving parts are third inclined surfaces inclined inward and downward;

the swing button is provided in an upper part of the outer fixed block;

the swing button comprises a first button body and a first sliding cover;

a top surface of the first button body is provided with a first sliding groove;

the first sliding cover is located in the first sliding groove;

a bottom of the first sliding cover is provided with a first connecting rod;

the first button body is provided with a first sliding space;

the first sliding space is provided therein with a first sliding part;

a second spring is provided between a side surface of the first sliding part and a side surface of the first sliding space;

a bottom of the first connecting rod passes through the first button body and is connected to the first sliding part;

the outer fixed block is provided therein with a second pressing part;

an outer side surface of the second pressing part is provided with a fourth inclined surface fitting the top surfaces of the second driving parts;

the first sliding part is located above the second pressing part;

a bottom surface of the first button body abuts against a top surface of the second pressing part;

left and right side surfaces of the second pressing part both are provided with two grooves, wherein the two grooves are spaced apart;

left and right ends of a bottom surface of the first sliding part both are provided with two protruding parts, wherein the two protruding parts are spaced apart;

the two protruding parts correspond to two grooves on the same side;

the outer fixed block is provided therein with two left clamping points and two right clamping points, wherein the two left clamping points are spaced apart and the two right clamping points are spaced apart;

the two left clamping points are located in corresponding two grooves;

the two right clamping points are located in corresponding two grooves;

bottom surfaces of the protruding parts are fifth inclined surfaces that are inclined rearward and downward;

top surfaces of the left clamping points and the right clamping points are sixth inclined surfaces, wherein the sixth inclined surfaces fit the fifth inclined surfaces;

the inner end surface of the opening is provided with a splayed clamping edge that is adapted to and abuts against the splayed clamping block;

the connecting part is provided with a guide rod;

the outer fixed block is provided with a central shaft; the central shaft is provided with a rod hole for the guide rod to pass through; and a third spring is provided between the connecting part and the outer fixed block.

5. The safe bassinet according to claim 4, wherein the splayed clamping block is shaped like a left square bracket "[" in a top view;

the splayed clamping block is provided therein with a vertical plate and a pusher;

a top outer side surface of the vertical plate is a seventh inclined surface inclined inward and downward;

a rear top surface of the pusher is an eighth inclined surface fitting the seventh inclined surface;

the pusher is shaped like "[" in a left view;

the pusher is located at an outer end of the vertical plate; there are two second driving parts;

the two second driving parts are spaced apart in front and rear directions;

a top transverse part of the pusher passes between the two second driving parts, and a bottom transverse part of the pusher is located below the connecting part;

the top transverse part and the bottom transverse part of the pusher pass through the outer fixed block;

an inner end surface of the inner fixed block is provided with a rod groove;

the rod groove is provided therein with a strip groove;

a clamping rod is provided in the rod groove;

an inner end surface of the clamping rod is provided with an abutting protrusion;

an outer end surface of the clamping rod is provided with a connecting bar;

the connecting bar passes through the strip groove and is connected to a bottom of the vertical plate;

the vertical plate and the pusher are located in the inner fixed block;

a fourth spring is provided between the bottom of the vertical plate and an inner bottom surface of the inner fixed block;

a movable member is provided between the inner bending shell and the outer bending shell;

an outer periphery of the movable member is evenly provided with a plurality of clamping parts;

an outer end of the outer fixed block is provided with a plurality of clamping grooves;

each clamping groove corresponds to one clamping part;

the plurality of clamping parts pass through the inner bending shell and are clamped in the corresponding clamping grooves;

an inner end surface of the movable member is provided with two abutting rods;

the top transverse part and the bottom transverse part of the pusher respectively correspond to one of the two abutting rods;

the two abutting rods pass through the inner bending shell and are located in the outer fixed block;

a fifth spring is provided between the movable member and the outer bending shell;

an outer end of the outer fixed block is evenly provided with a plurality of limit rods;

the inner bending shell is evenly provided with a plurality of arc through holes; each limit rod corresponds to and passes through one of the plurality of arc through holes; and the guide rod passes through the inner bending shell.

6. The safe bassinet according to claim 5, wherein an outer end of the inner bending shell is provided with two symmetrical sleeve posts, two symmetrical centering springs and two symmetrical connecting members;

each of the two symmetrical centering springs corresponds to one of the two symmetrical sleeve posts and one of the two symmetrical connecting members; a first end of the centering spring is sleeved on the sleeve post, and a second end of the centering spring is clamped on the connecting member;

the two connecting members respectively correspond to one arc through hole; and inner ends of the connecting members are connected to the corresponding limit rods.

7. The safe bassinet according to claim 1, wherein the left support frame and the right support frame respectively comprise a support sleeve, a support base, a support rod and a sleeve rod;

a bottom of the support base is connected to the support sleeve;

a bottom of the support rod is connected to a top of the support base;

the sleeve rod is sleeved on the support rod, and the sleeve rod is configured to ascend and descend relative to the support rod;

the bottom of the sleeve rod is provided with a clamping device for adjusting a height of the sleeve rod;

the left bending rod and the right bending rod are respectively provided with a lift button for pulling the clamping device up and down;

a pull rope is provided between the lift button and the clamping device; and a bottom of the lift button extends out of the bottom of the corresponding left bending rod or right bending rod.

8. The safe bassinet according to claim 7, wherein the lift button comprises a second button body and a second sliding cover;

a bottom surface of the second button body is provided with a second sliding groove;

the second sliding cover is located in the second sliding groove;

a top of the second sliding cover is provided with a second connecting rod;

the second button body is provided therein with a second sliding space;

the second sliding space is provided with therein a second sliding part;

a sixth spring is provided between one end of the second sliding part and one end of the second sliding space;

a top of the second connecting rod passes through the second button body and is connected to the second sliding part;

a first end of the second button body is hinged to an inner bending shell and an outer bending shell, and a second end of the second button body is provided with a pull rod;

a seventh spring is provided between the pull rod and an upper part of the inner bending shell;

a winding wheel is provided in the inner bending shell;

a first end of the pull rope is connected to a bottom of the pull rod, and a second end of the pull rope is wound around the winding wheel and is connected to the clamping device;

a top surface of the second button body is provided with two symmetrical limit cuts;

inner and outer ends of the second sliding part are respectively provided with extending parts, wherein the extending parts abut against one of the two symmetrical limit cuts correspondingly;

the inner bending shell is provided therein with an abutting part extending outward; and when the second sliding part is in a non-sliding state, a top surface of the second sliding part abuts against the abutting part.

9. The safe bassinet according to claim 7, wherein the clamping device comprises a casing, a lifting block and a clamping block;

the casing is fixedly provided at a bottom of the sleeve rod;

the lifting block and the clamping block are arranged in the casing;

the lifting block is configured to drive the clamping block to move in left and right directions;

an outer side surface of the clamping block is provided with a clamping plate;

an inner side surface of the support rod is provided with a plurality of clamping openings, wherein the plurality of clamping openings are spaced apart vertically, and one end of the clamping plate is configured to be clamped into the plurality of clamping openings;

a bottom of the pull rope is connected to the lifting block;

an eighth spring is provided between a top surface of the lifting block and an inner top surface of the casing;

the lifting block comprises a head part and a third driving part;

a junction of the head part and the third driving part is a bending part;

a front side surface of the bending part is a ninth inclined surface;

a top surface of the clamping block is a tenth inclined surface fitting the ninth inclined surface;

a protrusion is provided on a top inner side surface of the clamping block;

a bottom surface of the protrusion is an eleventh inclined surface;

an outer side surface of the protrusion abuts against an inner side surface of the third driving part;

the inner side surface of the third driving part is provided with a twelfth inclined surface fitting the eleventh inclined surface;

a ninth spring is provided between an inner side surface of the clamping block and an inner side surface of the casing;

a lower rear side surface of the clamping block is provided with a limit plate; and the limit plate is located below the third driving part.

10. The safe bassinet according to claim 1, wherein the sleeping basket frame comprises a left guide rail, a right guide rail, a lifting tube, a bottom rod, an upper bending tube and a lower bending tube;

the upper bending tube is provided between a top front end of the left guide rail and a top front end of the right guide rail;

the lower bending tube is provided between a bottom front end of the left guide rail and a bottom front end of the right guide rail;

the bottom rod is provided between a bottom inner side of the left guide rail and a bottom inner side of the right guide rail;

an inner side surface of the left guide rail and an inner side surface of the right guide rail are respectively provided with a lifting member;

the lifting tube is provided between the lifting member of the left guide rail and the lifting member of the right guide rail;

the lower bending tube is provided with two symmetrical lower tube sleeves;

the upper bending tube is provided with two symmetrical upper tube sleeves;

each of the two symmetrical lower tube sleeve corresponds to one of the two symmetrical upper tube sleeves;

a reinforcing rod is correspondingly provided between one of the two symmetrical upper tube sleeves and one of the two symmetrical lower tube sleeves;

bottoms of the two symmetrical lower tube sleeves are respectively provided with a sleeve with an open structure inside;

the sleeve is sleeved on the lower bending tube; and the left slider and the right slider are connected to the upper bending tube.

11. The safe bassinet according to claim 10, wherein the cloth cover comprises a front cloth cover and a rear cloth cover;

the front cloth cover is connected to the upper bending tube and the lower bending tube;

an upper part of the rear cloth cover is sleeved on the lifting tube;

a left end and a right end of the rear cloth cover are respectively provided with a left zipper belt and a right zipper belt;

the left zipper belt and the right zipper belt are respectively provided with zipper teeth;

the left guide rail and right guide rail are respectively provided with a hollow structure;

the left guide rail and the right guide rail both comprise a front guide shell and a rear guide shell, wherein the front guide shell and the rear guide are connected to each other;

a front partition is provided in the front guide shell, and a rear partition is provided in the rear guide shell;

a first through hole from top to bottom is formed on an inner side surface after the front guide shell and the rear guide shell are connected;

a second through hole from top to bottom is formed between the front partition and the rear partition after the front guide shell and the rear guide shell are connected;

the left zipper belt and the right zipper belt pass through the first through hole and the second through hole, correspondingly;

the zipper teeth of the left zipper belt and the zipper teeth of the right zipper belt are respectively located in the left guide rail and the right guide rail;

the zipper teeth of the left zipper belt block an outer side of the front partition and the rear partition in the left guide rail;

the zipper teeth of the right zipper belt block an outer side of the front partition and the rear partition in the right guide rail;

a bottom of the rear cloth cover is wound around a bottom of the bottom rod;

the bottom of the rear cloth cover is provided with a plurality of elastic belts;

a front end of the lower bending tube is provided with a plurality of winding members;

each winding member corresponds to one of the plurality of elastic belts;

each winding member is provided with a winding hole;

a first end of each elastic belt is connected to one side surface of the bottom of the rear cloth cover; and a second end of each elastic belt correspondingly passes through the winding hole and is connected to the other side surface of the bottom of the rear cloth cover.

12. The safe bassinet according to claim 7, wherein a telescopic inner tube is provided in a rear end of the support sleeve;

a compression spring is provided in the support sleeve along a length direction;

a front end of the inner tube is provided therein with a V-shaped elastic piece;

a top surface of the V-shaped elastic piece is provided with a clamping bead;

a rear top surface of the inner tube is provided with a clamping hole for the clamping bead to extend outward;

the clamping bead is located on a rear side of the support sleeve;

the rear end of the support sleeve is provided with a connecting post, wherein the connecting post is L-shaped in a top view;

an end of the connecting post is provided with a frustum part;

a transverse part of the connecting post is provided with a slit;

the slit respectively divides the transverse part and the frustum part of the connecting post into two halves;

the rear end of the support sleeve is provided with a lug; and the lug is provided with a circular hole, wherein the two halves of the frustum part are inserted into the circular hole.

* * * * *